US010767248B2

(12) United States Patent
Lee et al.

(10) Patent No.: US 10,767,248 B2
(45) Date of Patent: *Sep. 8, 2020

(54) PLASTIC DEFORMATION MAGNESIUM ALLOY HAVING EXCELLENT THERMAL CONDUCTIVITY AND FLAME RETARDANCY, AND PREPARATION METHOD

(71) Applicant: In-Young Lee, Gwangmyeong-si, Gyeonggi-do (KR)

(72) Inventors: In-Young Lee, Gwangmyeong-si (KR); Kang-Hyung Kim, Asan-si (KR); Hyun-Seok Jeon, Pyeongtaek-si (KR)

(73) Assignee: In-Young Lee, Gwangmyeong-si, Gyeonggi-do (KR)

( * ) Notice: Subject to any disclaimer, the term of this patent is extended or adjusted under 35 U.S.C. 154(b) by 151 days.

This patent is subject to a terminal disclaimer.

(21) Appl. No.: 15/553,688

(22) PCT Filed: Feb. 24, 2016

(86) PCT No.: PCT/KR2016/001771

§ 371 (c)(1),
(2) Date: Aug. 25, 2017

(87) PCT Pub. No.: WO2016/137211

PCT Pub. Date: Sep. 1, 2016

(65) Prior Publication Data

US 2018/0030578 A1 Feb. 1, 2018

(30) Foreign Application Priority Data

Feb. 25, 2015 (KR) ..... 10-2015-0026497

(51) Int. Cl.
*C22C 23/04* (2006.01)
*C22C 1/02* (2006.01)
*C22C 23/06* (2006.01)

(52) U.S. Cl.
CPC ..... *C22C 23/04* (2013.01); *C22C 1/02* (2013.01); *C22C 23/06* (2013.01)

(58) Field of Classification Search
CPC ..... C22C 23/04; C22C 23/06; C22C 1/02
See application file for complete search history.

(56) References Cited

U.S. PATENT DOCUMENTS

| | | | | |
|---|---|---|---|---|
| 5,552,110 | A * | 9/1996 | Iba | C22C 23/02 420/405 |
| 2003/0000608 | A1* | 1/2003 | Horie | C22C 23/04 148/666 |
| 2008/0138236 | A1 | 6/2008 | Bae et al. | |
| 2011/0192500 | A1* | 8/2011 | Uggowitzer | A61L 31/022 148/406 |
| 2014/0332121 | A1* | 11/2014 | Park | C22F 1/06 148/557 |

FOREIGN PATENT DOCUMENTS

| | | | | |
|---|---|---|---|---|
| GB | 933356 | * | 8/1963 | C22C 23/04 |
| JP | 07-003374 | A | 1/1995 | |
| KR | 10-0509648 | B1 | 8/2005 | |
| KR | 10-0519721 | B1 | 10/2005 | |
| KR | 10-2006-0098039 | A | 9/2006 | |
| KR | 10-1276665 | B1 | 6/2013 | |
| KR | 10-1367892 | B1 | 2/2014 | |
| KR | 10-2014-0063025 | A | 5/2014 | |
| KR | 10-1392480 | B1 | 5/2014 | |
| KR | 10-1406111 | B1 | 6/2014 | |
| KR | 10-2015-0017143 | A | 2/2015 | |
| KR | 10-1594857 | B1 | 2/2016 | |
| KR | 10-1600590 | B1 | 3/2016 | |
| WO | PCT/KR2016/001770 | | 9/2016 | |

OTHER PUBLICATIONS

Fan, Yu, et al. "Influence of lanthanum on the microstructure, mechanical property and corrosion resistance of magnesium alloy." Journal of materials science 41.17 (2006): 5409-5416.*

Ed. G. L. Song, "Corrosion of Magnesium Alloys and Metallurgical Influence", Woodhead Publishing Limited, 2011, pp. 137-146.

Alexandra Rudajevova et al., "On the Thermal Characteristics of Mg-Based Composites", Kompozyty (Composites), 2004, pp. 133-137, vol. 4, No. 10.

Andrzej Kielbus et al., "The Thermal Diffusivity of Mg—Al—Sr and Mg—Al—Ca—Sr and Casting Magnesium Alloys", Defect and Diffusion Forum, Apr. 2012, pp. 249-254, vol. 326-328.

* cited by examiner

*Primary Examiner* — Jessee R Roe
(74) *Attorney, Agent, or Firm* — Rabin & Berdo, P.C.

(57) ABSTRACT

Disclosed is a magnesium alloy that has high thermal conductivity and flame retardancy and facilitates plastic working, wherein magnesium is added with 0.5 to 5 wt % of zinc (Zn) and 0.3 to 2.0 wt % of at least one of yttrium (Y) and mischmetal, with, as necessary, 1.0 wt % or less of at least one selected from among calcium (Ca), silicon (Si), manganese (Mn) and tin (Sn), the total amount of alloy elements being 2.5 to 6 wt %. A method of manufacturing the same is also provided, including preparing a magnesium-zinc alloy melt in a melting furnace, adding high-melting-point elements in the form of a master alloy and melting them, and performing mechanical stirring during cooling of a cast material in a continuous casting mold containing the magnesium alloy melt, thus producing a magnesium alloy cast material having low segregation, after which a chill is removed from the cast material or diffusion annealing is performed, followed by molding through a tempering process such as rolling, extrusion or forging. This magnesium alloy is improved in ductility by the action of alloy elements for inhibiting the formation of lamella precipitates due to a low-melting-point eutectic phase in a magnesium matrix structure, can be extruded even at a pressure of 1,000 kgf/cm$^2$ or less due to the increased plasticity thereof, and can exhibit thermal conductivity of 100 W/m·K or more and flame retardancy satisfying the requirements for aircraft materials and is thus suitable for use in fields requiring fire safety, thereby realizing wide application thereof as a heat sink or a structural material for portable appliances, vehicles and aircraft components and contributing to weight reduction.

2 Claims, 31 Drawing Sheets

PLASTIC DEFORMATION MAGNESIUM ALLOY HAVING EXCELLENT THERMAL CONDUCTIVITY AND FLAME RETARDANCY, AND PREPARATION METHOD

TECHNICAL FIELD

The present invention relates to a magnesium alloy that has high thermal conductivity and flame retardancy and facilitates plastic working, which is configured such that magnesium is added with 0.5 to 5 wt % (hereinafter, % indicates wt %) of zinc such that zinc is solid-solved to thus improve ductility, and is also added with 0.3 to 2.0 wt % of at least one of yttrium (Y) and mischmetal, and, as necessary, 1.0 wt % or less of at least one selected from among calcium (Ca), silicon (Si), manganese (Mn) and tin (Sn), so that the total amount of alloy elements is 2.5 to 6 wt %.

In addition, the present invention relates to a method of manufacturing a magnesium alloy that has high thermal conductivity and flame retardancy and facilitates plastic working, comprising: melting a magnesium ingot in a crucible mold positioned in a melting furnace with an air shut-off, thus obtaining a magnesium melt, which is then maintained at a temperature of 680 to 720° C.; melting zinc in the magnesium melt, thus obtaining a magnesium-zinc alloy melt; adding the magnesium-zinc alloy melt with a high-melting-point alloy element (at least one selected from among yttrium, mischmetal, calcium, silicon and manganese) in the form of a master alloy and then performing mechanical stirring, thus obtaining a magnesium alloy melt; and cooling the crucible mold containing the magnesium alloy melt in a cooling bath or through spraying of a coolant in a continuous casting mold, thus producing a cast material.

BACKGROUND ART

As known in the art, use of a magnesium alloy, which is the most lightweight of currently useful metal materials, as a material for various metal components in lieu of aluminum is drastically increasing in order to achieve further weight reduction, and demand therefor is considerably increasing to address the issue of fuel efficiency of vehicles and aircraft and application to mobile electronic products.

A magnesium alloy has a density of 1.74 g/cc, which is the lightest among commercially available structural alloys, and the density thereof corresponds to ⅔ of the density of aluminum. Furthermore, a magnesium alloy has superior machinability, high vibration damping capacity, high ability to absorb vibrations and impact, and excellent electromagnetic wave-shielding performance. The reason why the application of a magnesium alloy to computers, mobile phones, components for vehicles, etc. has recently increased is that it is lightweight and has high recycling rate and the ability to shield electromagnetic waves, and casting thereof into a thin profile is possible because castability is superior to that of aluminum.

However, magnesium has a hexagonal close-packed lattice structure having not many slip system, which is essential for plastic deformation, and forming thereof is mainly performed through casting owing to poor extrudability or formability. Here, sand casting makes it difficult to form a desired shape, and die casting causes many problems in the subsequent surface treatment process because the cast structure thereof is porous. Then, materials such as AZ31, AM20 and the like are manufactured by alloying aluminum and zinc or manganese, whereby plastic working using the ductility of a single-phase solid solution becomes possible. However, these materials are developed so as to have a basal texture after annealing treatment, and a plate or a profile subjected to unidirectional plastic deformation has high anisotropy and makes it easy to form extension twins, and the commercialization thereof is delayed owing to problematic plastic working upon real-world application despite the high ductility thereof.

Since extrusion at a temperature of 400° C. or more is carried out in a temperature range in which a low-melting-point eutectic liquid phase and an alpha-magnesium solid solution co-exist due to frictional heat with a die, wrinkle-like defects, in which fine surface cracks resembling fingerprints appear, may occur. Such fine surface defects may decrease fatigue strength and thus must be removed. In actual fields, however, the removal thereof is not easy in terms of cost, environmental factors, and safety issues due to dust ignition. In order to obtain clean products having no surface defects, an extrusion process is performed at a temperature of 350° C. or less. To this end, the processing pressure has to be increased to at least five times 1000 $kgf/cm^2$, which is the extrusion pressure of aluminum.

Moreover, conventional AZ- and AM-based magnesium alloys mainly used for a wrought product are problematic because flame retardancy is not assured due to a low-melting-point eutectic phase.

Such AZ- and AM-based magnesium alloys are disadvantageous in that copper (Cu) or high-melting-point iron-based impurities (Fe, Ni) having low solubility may form initial precipitates during the solidification thereof, and a beta-$Mg_{17}Al_{12}$ compound of aluminum and magnesium, which is subsequently precipitated, may form coarse plate-like precipitates, and such precipitates are thus interconnected and heat transfer is thus blocked, and thermal conductivity is remarkably lowered even by the addition of about 3 to 4% thereof (Ed. G. L. Song, Corrosion of Magnesium Alloys, 2011, pp. 137-146).

Thus, when a flame is applied to such a material, it is easy to drastically partially increase the temperature of the heated portion of the structure owing to its low thermal conductivity. When it is dissolved, it easily reacts with oxygen in the air and ignites, and even when the flame is extinguished, it is difficult to decrease the temperature of the material due to slow thermal diffusion, and thus combustion continues, making it difficult to achieve rapid extinguishment, and thus ensuring safety becomes impossible. The concern about fire affects not only vehicles but encompasses all industries, and the application thereof has thus been greatly delayed.

For this reason, many attempts have been made to add rare earth metals to magnesium in order to impart magnesium with flame retardancy.

Conventional materials therefor may include alloys such as WE43, ZE41, ZE10 or Elektron 21, containing rare earth elements such as yttrium, niobium (Nb), samarium (Sm), ytterbium (Yb), gadolinium (Gd), neodymium (Nd) and zirconium (Zr). These alloys manifest excellent flame retardancy due to a strong oxide film constituted by a rare earth element but require a large amount of expensive elements or have poor plastic workability, and thus do not adequately satisfy market requirements. When the rare earth element is contained in an amount of 4% or more, adverse effects in which ductility is remarkably decreased occur, and thermal conductivity is generally decreased with an increase in the amount of the alloy element that is added. In particular, zirconium functions to fine the grain size and to increase flame retardancy but has very low thermal conductivity and plastic workability. Hence, even when zirconium is added in an amount of about 1% to magnesium, thermal conductivity may be lowered by 50 to 70%.

As alloys containing zirconium, WE43 has thermal conductivity of 51 to 54 W/m·K and ZE41 has thermal conductivity of 24 W/m·K, and these are mainly used as casting materials, rather than plastic working materials, due to the low ductility thereof. Elektron 21 contains about 4% of a rare earth element and 0.5% or less of zinc and thus exhibits high thermal conductivity of 116 W/m·K and superior ignition suppression performance but very low elongation of about 2%, making it difficult to perform plastic working. ZE10, containing zirconium, has low thermal conductivity and plastic workability and has to be molded through a special molding process such as ECAP, making it difficult to actually use in plastic working applications in industrial sites.

Korean Patent No. 10-1367892 discloses a high-temperature magnesium alloy and a method of manufacturing the same, in which a magnesium alloy melt is added with 0.5 to 3.8% of calcium oxide (CaO), and aluminum and calcium are combined while calcium oxide is reduced, thus imparting flame retardancy. However, this alloy suffers from very low plastic workability.

Furthermore, a method of increasing thermal conductivity by mixing magnesium with silicon carbide (SiC) or fibrous alumina has been disclosed, but plastic workability is deteriorated, and thus the method is unsuitable for use in a tempering process (A. Rudajevova et al., On the Thermal Characteristics of Mg-Based Composites, Kompozyty, 4, 10, 2004).

Hence, the production of a magnesium alloy imparted with both flame retardancy and plastic workability is regarded as difficult.

Korean Patent No. 10-0509648, in which plastic workability is increased by the addition of a rare earth element, discloses a method of manufacturing a magnesium alloy plate having superior plastic workability from a magnesium alloy configured such that magnesium is added with zinc and yttrium. In this patent, a melt containing 0.5 to 5.0% of zinc and 0.2 to 2.0% of yttrium is cast into a plate-like material having a thickness of 35 mm, annealed and then rolled into a plate having a thickness of 1.0 mm, thus increasing the plastic workability of a rolled plate, but center segregation upon casting into billets having a large diameter of 75 mm or more and zinc gravitational segregation, which becomes severe when the zinc content is 3% or more, have not yet been overcome. Furthermore, this patent does not consider improvements in flame retardancy of the material at all.

In order to increase thermal conductivity and high-temperature stability of the material, a conventional AZ-based magnesium alloy is added with an alkaline earth metal such as strontium (Sr) or calcium and combined with beta-$Mg_{17}Al_{12}$ to adjust the shape thereof (A. Kielbus et al., The Thermal Diffusivity of Mg—Al—Sr and Mg—Al—Ca—Sr and Casting Magnesium Alloys, Defect and Diffusion Forum, Vol. 326-328, 2012, pp. 249-254). The strontium or calcium functions to increase the surface tension of a beta-phase precipitate to thus suppress the formation of the precipitate into a lamella phase at grain boundaries, and also, the size of the precipitate is decreased to thus improve thermal conductivity, and when the melt is exposed to flame, a dense surface oxide film is formed and ignition is thus prevented. However, this material is composed of 6 to 9% of aluminum with 0.8 to 2% of strontium or 1.5 to 2.2% of calcium, the total amount of alloy elements being 8 to 11%, whereby the resulting alloy has low ductility and is unsuitable for use in a tempering process. Furthermore, the thermal conductivity of this alloy is increased by about 75% compared to the thermal conductivity of AZ91, but is still only 87 W/m·K, similar to that of AZ31, and thus does not reach thermal conductivity of 100 W/m·K or more, which is desired in the present invention.

Korean Patent No. 10-1276665 discloses a magnesium alloy for plastic working, in which magnesium is added with 4 to 10% of tin and 0.05 to 1.0% of calcium, thus ensuring desired flame retardancy. However, in this patent, since a melt temperature has to be maintained at 850 to 900° C. in order to dissolve high-melting-point elements such as calcium, manganese, yttrium, erbium, etc., gas solid solubility and oxide content in the melt are unnecessarily increased, and thus the concentration of impurities is increased, and moreover, the likelihood of ignition of the melt is high, undesirably deteriorating working safety.

As an alternative thereto, Korean Patent No. 10-1406111 discloses a magnesium alloy composed mainly of magnesium and containing 6.5 to 7.5% of tin and 1% of each of zinc and aluminum.

These alloys are improved in flame retardancy but still exhibit low plastic workability and thermal conductivity due to the presence of a large amount of tin, having high precipitation hardenability, and thus, in order to extrude billets therefrom, thermal treatment for a long period of time at a high temperature of 480 to 500° C. and an extrusion pressure of 9946 kgf/cm$^2$ are required, making it difficult to perform plastic working at a pressure of 1000 kgf/cm$^2$ or less, which is a typical aluminum extruder pressure in the related industry.

Also, Korean Patent No. 10-0519721 discloses a high-strength magnesium alloy composed basically of magnesium and 6% of zinc and further comprising 0.4 to 3% of manganese, aluminum, silicon or calcium. However, when this alloy is manufactured into commercially available billets, the large amount of zinc may cause gravitational segregation, and thus billets may break down during extrusion, or plastic workability may decrease, and only high strength and plastic workability are mentioned in the detailed description thereof, and no grounds for expecting good performance in flame retardancy or thermal conductivity are found therein.

In this way, the magnesium alloy has been developed in terms only of plastic workability or flame retardancy at an early stage, but for actual commercialization thereof, both thermal conductivity and flame retardancy should be satisfied and plastic workability also has to be ensured. In order to commercialize the structural material, simply satisfying only strength and moldability is insufficient, and ignition of the magnesium material in the event of a fire should be inhibited in order to prevent the spread of fire and ensure safety.

With the goal of promoting this delayed technological development, the Federal Aviation Administration (FAA), U.S.A., realistically revised the standards for flammability testing of magnesium alloys for aircraft seat structures.

According to this regulation (DOT/FAA/TC-13/52) amended in 2014, unless the initial weight is reduced by 10% or more in a flammability test for a total of 7 min, in which ignition should not occur within 2 min when exposed to an oil burner flame for 4 min (240 sec) and in which self-extinguishment should occur within 3 min after the burner is turned off, the magnesium alloy meets the performance standard.

FIG. 1 schematically shows a flammability tester for a magnesium alloy for use in an aircraft approved by the FAA and a test specimen.

DISCLOSURE

Technical Problem

Accordingly, the present invention has been made keeping in mind the problems encountered in the related art, and the present invention is intended to provide a magnesium alloy for use in a tempering process and a method of manufacturing the same, in which the magnesium alloy is configured such that magnesium is added with 0.5 to 5 wt % of zinc (Zn) and 0.3 to 2.0 wt % of at least one of yttrium (Y) and mischmetal, with, as necessary, 1.0 wt % or less of at least one selected from among calcium (Ca), silicon (Si), manganese (Mn) and tin (Sn), so that the total amount of alloy elements is controlled to 2.5 to 6 wt %, thus exhibiting superior thermal conductivity and flame retardancy and improving plastic workability, whereby the magnesium alloy may be extruded even at a pressure of 1000 kgf/cm$^2$ or less and may manifest superior thermal conductivity of 100 W/m·K or more and flame retardancy.

Technical Solution

Therefore, the present invention provides a magnesium alloy having superior thermal conductivity and flame retardancy and improved plastic workability, which is configured such that magnesium is added with 0.5 to 5 wt % of zinc and 0.2 to 2.0 wt % of at least one of yttrium (Y) and mischmetal, with, as necessary, 1.0 wt % or less of at least one selected from among calcium (Ca), silicon (Si), manganese (Mn) and tin (Sn), so that the total amount of alloy elements is controlled to 2.5 to 6 wt %. Also in the magnesium alloy of the present invention, high-melting-point elements other than zinc and tin are added in the form of a master alloy, and mechanical stirring is performed during solidification so as to prevent chemical segregation, and casting is carried out. Thereafter, a surface chill is removed from the cast material, followed by diffusion annealing and then a tempering process such as rolling, extrusion or forging, thereby molding a predetermined profile.

Advantageous Effects

According to the present invention, a magnesium alloy has high ductility and can be subjected to plastic working without surface defects even at a low extrusion pressure of 1000 kgf/cm$^2$ or less, and exhibits superior thermal conductivity and flame retardancy and can thus satisfy thermal conductivity and flame retardancy required for portable appliances, vehicles, and aircraft components. Such a magnesium alloy extrudate can be inexpensively manufactured.

MODE FOR INVENTION

Figure 1:
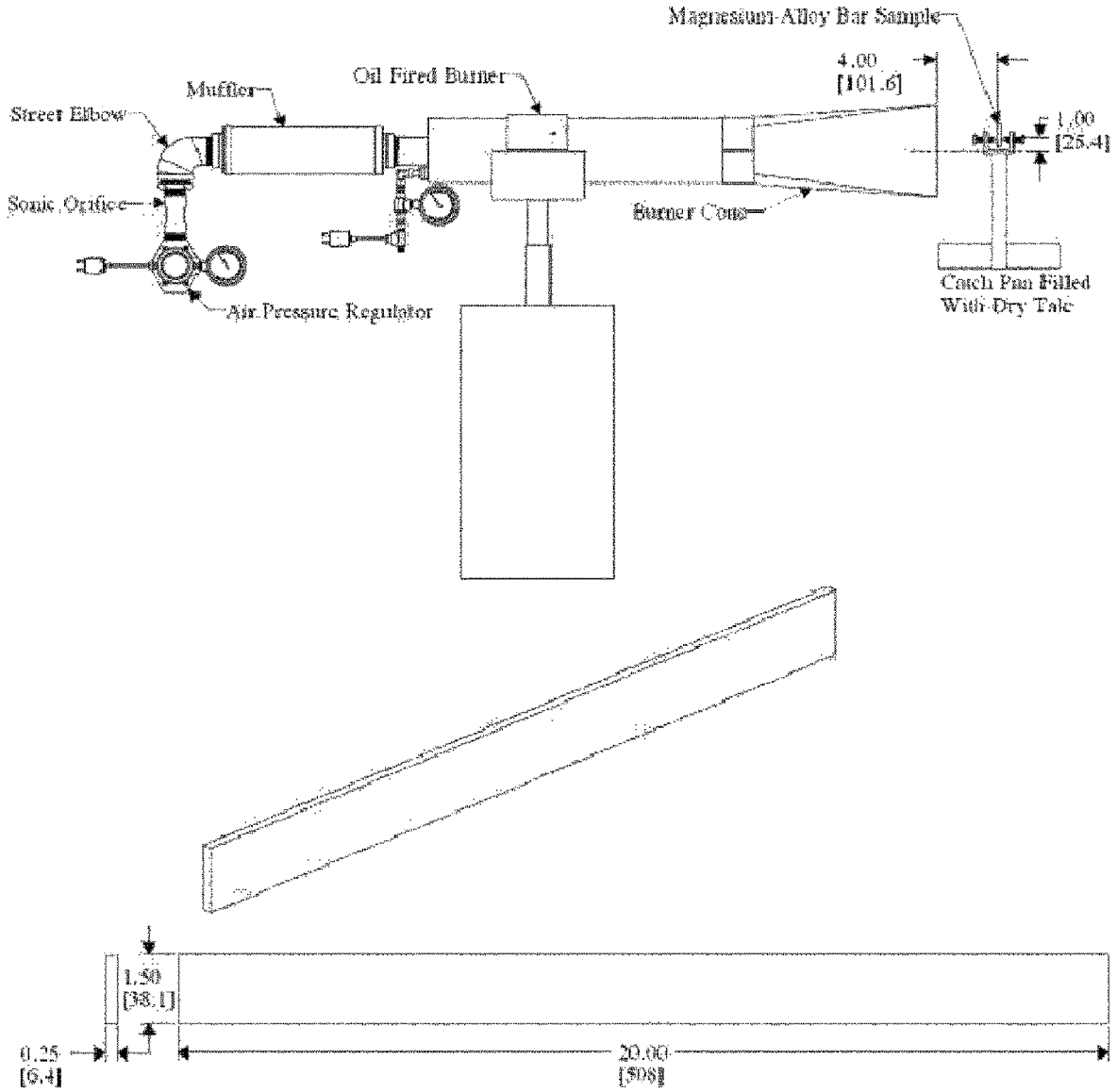
FIG. 1 schematically shows a flammability tester for a magnesium alloy for use in an aircraft approved by the FAA and a test specimen.

The present invention addresses a magnesium alloy having superior thermal conductivity and flame retardancy and high plastic workability, configured such that magnesium is added with 0.5 to 5% of zinc (Zn) and 0.3 to 2.0% of at least one of yttrium (Y) and mischmetal in the form of a master alloy, with, as necessary, 1.0 wt % or less of at least one selected from among calcium (Ca), silicon (Si), manganese (Mn) and tin (Sn), so that the total amount of alloy elements is controlled to 2.5 to 6%. Particularly in the magnesium alloy, the amount of expensive alloy element is remarkably lowered, thus realizing cost savings, and satisfactory flame retardancy may be obtained while preventing the melting point and thermal conductivity from decreasing.

In addition, the present invention addresses a method of manufacturing the magnesium alloy, characterized in that the high-melting-point alloy elements are added in the form of a master alloy, thus enabling dissolution of the high-melting-point alloy elements at a temperature of 720° C. or less and suppressing the formation of oxide impurities, thereby increasing thermal conductivity and flame retardancy, and moreover, mechanical stirring is performed during the solidification of the melt, thus decreasing segregation of the alloy elements to thereby exhibit superior ductility and easy plastic working.

In the present invention, the reason why the amounts of alloy elements that are added are limited as above is described below.

Zinc is solid-solved in Mg to thus change a c/a axis ratio, thereby inhibiting the development of a basal texture, and uniform plastic working becomes possible in the solid solution due to the work-hardening effects of $MgZn_2$ or $MgZn_5$ precipitates. However, if the amount thereof is less than 0.5%, the effects thereof become poor, making it difficult to satisfy work hardenability and ductility required for plastic working materials. On the other hand, if the amount thereof exceeds 5%, the basal texture, which deteriorates moldability after annealing treatment, may be reinforced, thus drastically decreasing plastic workability. Furthermore, the extent of segregation in the magnesium melt is increased, and precipitates such as $Mg_2Zn_3$, $Mg_{12}Zn_{13}$ and the like are stacked with the alpha phase to thus form a low-melting-point eutectic phase at about 340° C., undesirably deteriorating flame retardancy. Hence, the amount of zinc is preferably set to the range of 2.0 to 4.5%.

Yttrium is a solid-solution-strengthening element having a high solid solubility of 12.4% to magnesium and is useful in improving high-temperature creep resistance in a casting alloy. It forms a stable phase having a high melting point of 600° C. or more in the alloy of the invention, and may also form a dense $Y_2O_3$ oxide film having a high melting point of 2400° C. or more when exposed to flame, thus suppressing ignition and the oxidation of the melt to thereby increase flame retardancy. Furthermore, high-temperature strength is maintained high due to the high-temperature stable phase, and warping, sagging or melt-bar separation at high temperatures due to the presence of flame may be greatly suppressed. This element is solid-solved in a magnesium matrix structure or is formed into a fine high-temperature stable phase such as a w-phase or an i-phase and thus dispersed, thereby contributing to improved plastic workability. During heating for a tempering process, the formation of an incoherent $Mg_2Zn_3$ precipitate that decreases coherency with a matrix structure is inhibited, and the formation of an i-phase or a w-phase, which is an intermetallic compound having high coherency, is induced, thus improving ductility. However, when it is added alone in an amount of less than 0.3%, the effects thereof are insignificant. On the other hand, if the amount thereof exceeds 2.0%, the effects thereof are saturated, and solid-solution strengthening becomes excessive, in which case ductility decreases and costs are increased. Hence, taking into consideration the high cost and solid-solution-strengthening effects, the amount of yttrium is preferably set to the range of 0.4 to 1.5%.

Mischmetal is a rare earth alloy containing about 65 to 78% of cerium (Ce) and lanthanum (La), with the remainder of neodymium (Nd) and praseodymium (Pr) and inevitable impurities. Mischmetal may exhibit the same effect as lanthanum in the magnesium alloy, and is inexpensive and may manifest effects identical to those of lanthanum (La) or cerium (Ce), requiring a refining separation process, and thus may be used in lieu of lanthanum in order to reduce manufacturing costs. When cerium and neodymium are exposed to flame in air, oxide films such as $CeO_2$ and $Nd_2O_3$, having respective melting points of 2400° C. and 2200° C. or more, are formed, and flame retardancy may thus be exhibited. By virtue of the high-temperature stable phase, high-temperature strength is maintained high, and thus warping, sagging or melt-bar separation at high temperatures due to the presence of flame may be greatly suppressed.

However, if mischmetal having a large atomic weight is added alone in an amount of less than 0.3%, the effects thereof may be insignificant. On the other hand, if the amount thereof exceeds 2.0%, coarse precipitates may tend to form, and the effects thereof are saturated. Also, cerium, having a low solid solubility limit to magnesium, has a maximum solid solubility limit of 0.5%. In consideration of the cerium fraction, when mischmetal is added alone, the amount thereof is preferably set to the range of 0.4 to 1.0%, thus satisfying both plastic workability and flame retardancy. Also, in the present invention, the reason why constitutional elements in rare earth metals are represented as mischmetal is that the addition of individual metals may increase manufacturing costs, but the addition of individual metals does not depart from the scope of the invention.

Lanthanum may be used in lieu of mischmetal in the present invention. Lanthanum, which is a typical rare earth metal, has a high solid solubility limit of 12.4% to magnesium and is combined with a $MgZn_2$ precipitate to thus form a precipitate having a hexagonal long-period stacking ordered structure so that a lamellar eutectic phase is formed at grain boundaries. The precipitate is converted into a coherent intermetallic compound through spinodal decomposition during homogenization heat-treatment after the casting process, and is dispersed through a tempering process and thus contributes to dispersion strengthening. Upon exposure to flame in the air, lanthanum is formed into a $La_2O_3$ oxide film having a melting point of 2300° C. or more, and thus flame retardancy is exhibited. Furthermore, high-temperature strength is maintained high due to the high-temperature stable phase, and thus warping, sagging or melt-bar separation at high temperatures due to the presence of flame may be greatly suppressed. However, if lanthanum having a large atomic weight is added alone in an amount of less than 0.3%, the effects thereof are insignificant. On the other hand, if the amount thereof exceeds 2.0%, a coarse precipitate may tend to form, and the effects thereof are saturated. Hence, the amount thereof is preferably set to the range of 0.4 to 1.0%, thus satisfying both plastic workability and flame retardancy.

Tin is provided in the form of a high-temperature stable phase such as an $Mg_2Sn$ precipitate having a melting point of 560° C. or more and is thus appropriately distributed, thereby increasing high-temperature plastic workability. When it is exposed to flame in the air, a $SnO_2$ oxide film having a melting point of 1600° C. or more is formed to thus contribute to improving flame retardancy of the magnesium alloy. However, when it is excessively added, the ignition point is lowered while the melting point is decreased, and thus flame retardancy may be deteriorated somewhat. Furthermore, ductility may decrease due to an excess of the $Mg_2Sn$ precipitate, and manufacturing costs may increase. Hence, tin is added in an amount within 1.0%, as necessary.

Calcium, which is a Group 2 alkaline earth metal like magnesium, functions to form a secondary solidification phase such as $Mg_2Ca$ having a melting point of 715° C. between dendritic structures, or is solid-solved within the matrix structure together with zinc and is thus recrystallized in disordered directions during the heating process, thereby suppressing the development of a basal texture and fining crystal grains. When exposed to flame in the air, calcium is formed into a CaO oxide film having a melting point of 2600° C. or more, and thus flame retardancy is improved. Furthermore, high-temperature strength is maintained high due to the high-temperature stable phase, and thus warping, sagging or melt-bar separation at high temperatures due to the presence of flame may be greatly suppressed. However, when the amount of $Mg_2Ca$ particles is excessively increased with an increase in the amount of calcium that is added, ductility begins to decrease. Hence, the amount thereof is limited to 1.0% or less, thus satisfying both plastic workability and flame retardancy.

Silicon is added to form a high-temperature stable phase such as $Mg_2Si$ to thus fine a grain size and exhibit precipitation strengthening effects. Although the precipitate thereof may easily become coarse, the size or shape of the precipitate may be adjusted by the addition of calcium. When exposed to flame in the air, silicon is formed into a $SiO_2$ oxide film having a melting point of 1600° C. or more, and thus flame retardancy appears. Furthermore, high-temperature strength is maintained high due to the high-temperature stable phase, and thus warping, sagging or melt-bar separation at high temperatures due to the presence of flame may be greatly suppressed. However, when it is excessively added, a coarse precipitate may begin to form. Hence, the amount thereof is limited to 1.0% or less, thus satisfying both plastic workability and flame retardancy.

Manganese has a maximum solid solubility of 2.2% in magnesium. In the magnesium alloy, a peritectic reaction, in which an alpha phase of manganese is precipitated, and a monotectic reaction, in which a delta phase thereof is precipitated, may occur at 650° C., thus fining the grain size and improving corrosion resistance. In particular, when exposed to flame in air, manganese is formed into a MnO oxide film having a melting point of 1900° C. or more, and thus flame retardancy is improved. In the present alloy, manganese is effective at fining a coarse plate-like $Mg_{17}Al_{12}$ precipitate that is formed in the presence of aluminum impurities and also at fining an $MgZn_2$ precipitate in the course of recrystallization during annealing. Here, the melting point and ductility may decrease when the amount thereof is excessive. Hence, the amount thereof is limited to 1.0% or less, thus satisfying both plastic workability and flame retardancy.

In the present invention, the total amount of alloy elements is controlled to 2.5 to 6%, and high-melting-point alloy elements are added in the form of a master alloy upon dissolution, and mechanical stirring is performed during the solidification of the melt, thereby reducing segregation of the alloy elements to thus ensure ductility so as to enable extrusion even at a pressure of 1000 kgf/cm$^2$ or less.

Also, upon exposure to flame, a high-melting-point oxide film is formed on the surface of material, thus exhibiting flame retardancy and simultaneously satisfying thermal conductivity, ultimately suppressing melt-bar separation due to partial heating and shortening the self-extinguishing time of the melted-down material. A detailed description thereof is given below.

In the present invention, the reason why the total amount of alloy elements is controlled to 2.5 to 6% is as follows. If the total amount thereof is less than 2.5%, improvements in ductility and flame retardancy are insignificant. On the other hand, if the total amount thereof exceeds 6%, thermal conductivity may decrease due to the excessive amount of compounds and precipitates, and ductility and the melting point may decrease. Hence, the total amount thereof is limited as above.

When a rare earth metal or an alkaline earth metal is added in a large amount in the related art, ignition is suppressed and thus flame retardancy is improved, but the melting point of the material is lowered and the rate of thermal diffusion is decreased with an increase in the amount thereof that is added. In the event of a fire, when a portion exposed to flame is partially heated, early melt-down may occur and the time for which the portion remains melted may increase. Hence, in the present invention, the total amount of alloy elements is limited to 6% or less.

Also in the present invention, even when the total amount of alloy elements is controlled to 6% or less, thermal conductivity may be decreased in the excessive presence of aluminum or zirconium as an impurity. Even when aluminum is contained in an amount of about 3%, a large amount of coarse plate-like $Mg_{17}Al_{12}$ may be formed, and thus thermal conductivity may decrease, and a rare earth or alkaline earth metal element may be consumed, undesirably deteriorating flame retardancy. Hence, the amount of aluminum as an impurity is limited to 1% or less. Furthermore, zirconium is combined with other rare earth elements in the dendritic structure to thus form a lamellar structure at grain boundaries, thus remarkably decreasing thermal conductivity and increasing brittleness, undesirably deteriorating ductility. Hence, the amount of zirconium as an impurity is limited to 0.5% or less.

In the present invention, thermal conductivity of 100 W/m·K or more is exhibited through the above method, and at least one selected from among high-melting-point oxide-film-forming elements such as yttrium (Y), tin (Sn), calcium (Ca), silicon (Si), manganese (Mn) and mischmetal is contained in an amount of 0.3 to 2.0%, thus satisfying flame retardancy in a burner flammability test, including an ignition time of 120 sec or more, a test specimen extinguishing time within 180 sec after extinguishment of the burner, and a weight reduction of 10% or less.

In the present invention, in order to decrease the segregation of alloy elements in the melt and improve plastic workability and physical properties, high-melting-point alloy elements (yttrium, calcium, silicon, manganese, mischmetal, lanthanum) are added as the master alloy, with the exception of low-melting-point elements such as zinc and tin, upon alloying, and the resulting melt is mechanically stirred.

In magnesium alloys, there are many cases in which the difference in specific gravity between magnesium and other alloy elements is great. For example, zinc or tin is easy to segregate at the center or the bottom of the mold, and dendritic crystals may be coarsely developed, and thus a macroscopic composition of billets may become non-uniform and extrusion performance may decrease. In the case of severe segregation, hot tearing may occur at the center of a billet, and during the extrusion process, deformation, cracking and fine wrinkles may occur, and moreover, the extrudate may break down or may be decreased in fatigue strength during the stretching or correction thereof, undesirably deteriorating durability and reliability.

In the present invention, when the high-melting-point alloy elements are added in the form of the master alloy, the temperature of the melt is controlled to 720° C. or less and dissolution may become possible, thus decreasing the likelihood of ignition of the melt. Furthermore, solidification nuclei already formed in the mushy zone in the melt are dispersed through mechanical stirring, thus promoting uniform solidification in the melt, decreasing segregation and fining crystal grains. In particular, the magnesium alloy has no unpaired odd electrons and thus does not readily exhibit magnetic stirring effects owing to the low magnetizing force thereof. Hence, mechanical stirring is effectively used.

The specific method therefor is further described in detail in Examples.

The master alloy is produced in a manner in which lumps or grains composed mainly of alloy elements are added to a magnesium melt in a shielding gas atmosphere with an air shut-off so as to form a composition close to a eutectic composition, and mechanical stirring is performed, thereby lowering the melting point of the master alloy.

Based on the results of tests conducted by the present inventors, when mechanical stirring is conducted upon gravitational casting of a 30 kg magnesium alloy billet containing 4% zinc, the total chemical segregation difference of the upper and lower portions of the cast material is within 1%, but when mold casting is performed but stirring is not conducted, the segregation difference of the upper and lower portions thereof is 8% or more. In order to eliminate such segregation, mechanical stirring is effective. Such segregation may cause billets to break down at segregation boundaries upon subsequent extrusion, or may remain even after extrusion, resulting in visual defects and non-uniform physical properties.

In the present invention, mechanical stirring is performed using a motor and an impeller. Here, whether the mechanical stirring employs manpower or an alternative manner does not impact the scope of the present invention. In the present invention, when a solidification process is progressed inside the cast material (e.g. billet) subjected to mechanical stirring, the melt is stirred, whereby a high-temperature stable phase and high-temperature precipitates formed in a solid phase in a mushy zone in the melt are dispersed and thus function as solidification nuclei, and thus the structure of the cast material becomes uniform, segregation is eliminated, and crystal grains become fine.

Figure 2:
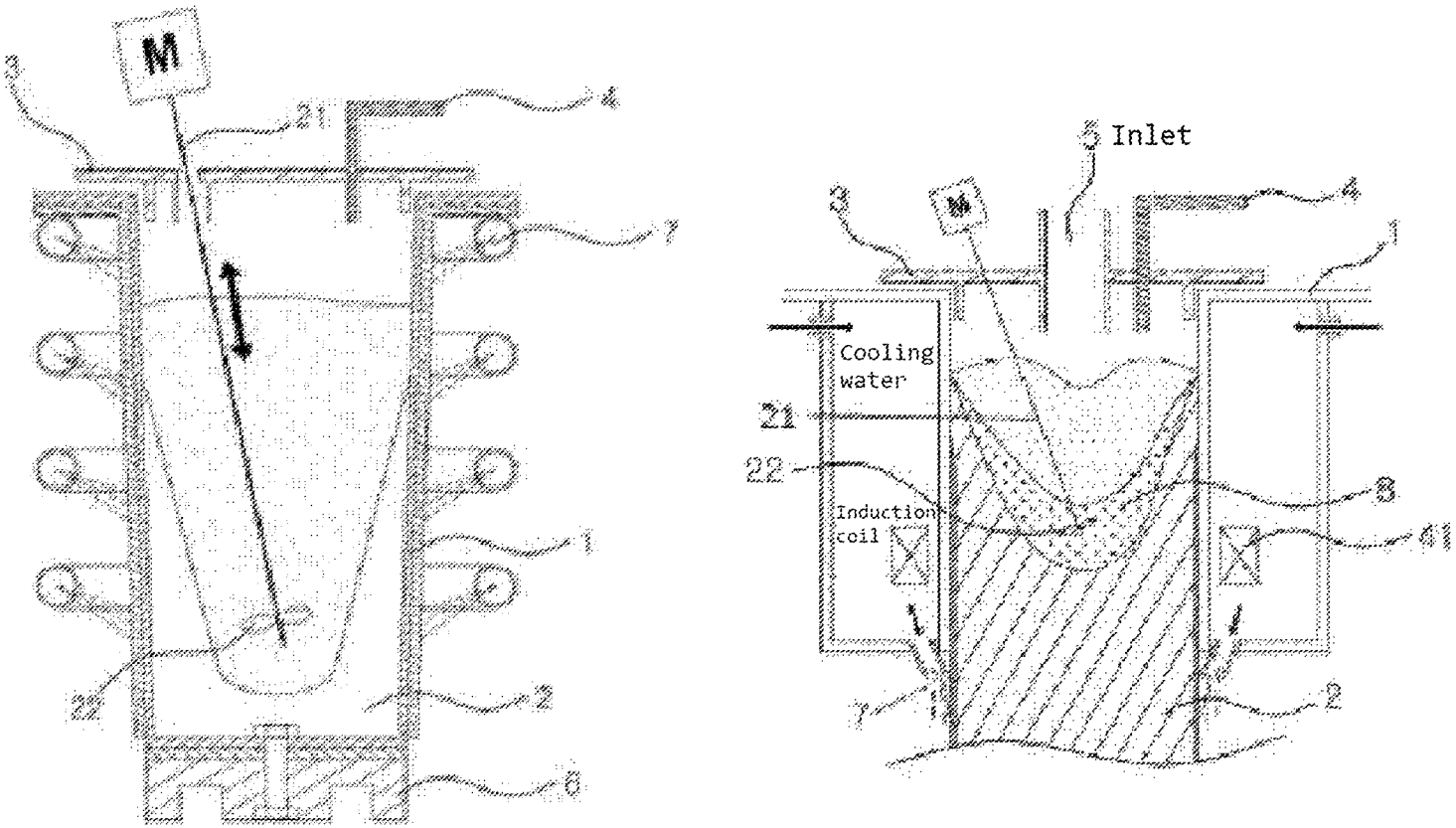
FIG. 2 schematically shows a solidification process of a crucible mold.
Figure 3:
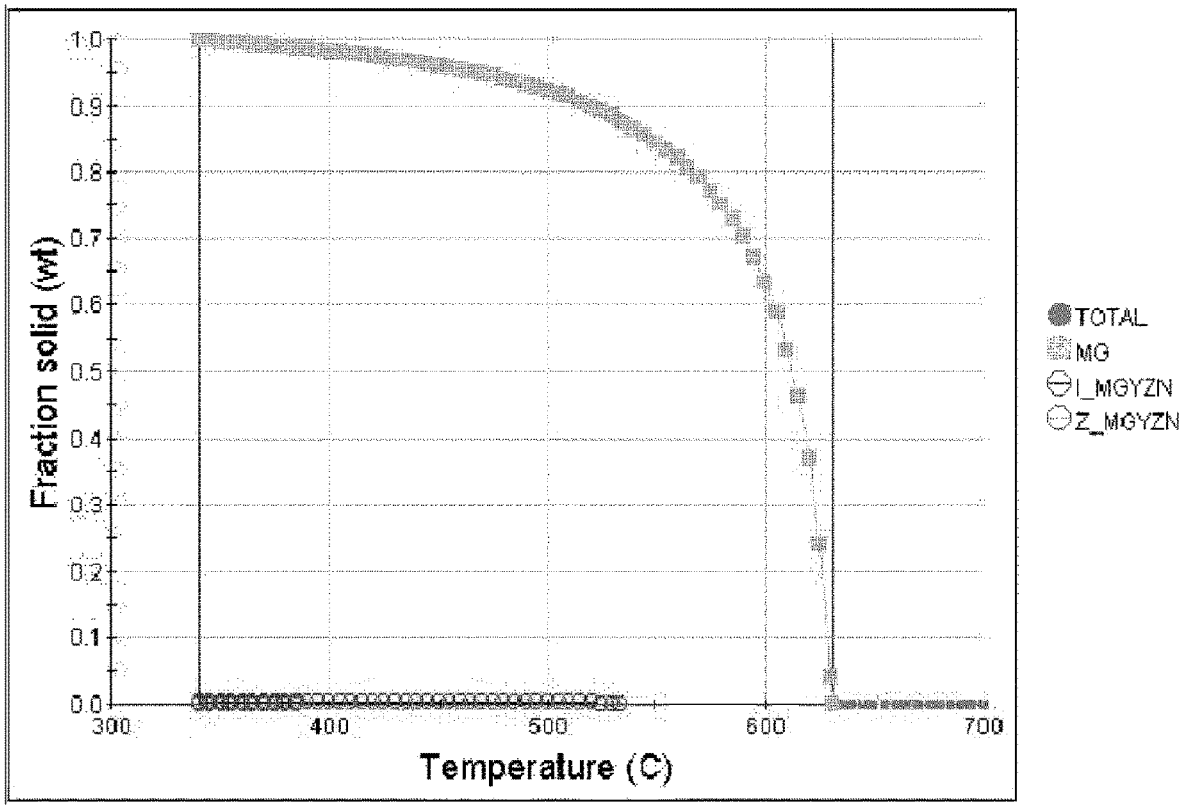
FIG. 3 shows the high-temperature stable phase precipitation diagram of Alloy 1 of Comparative Example.
Figure 4:
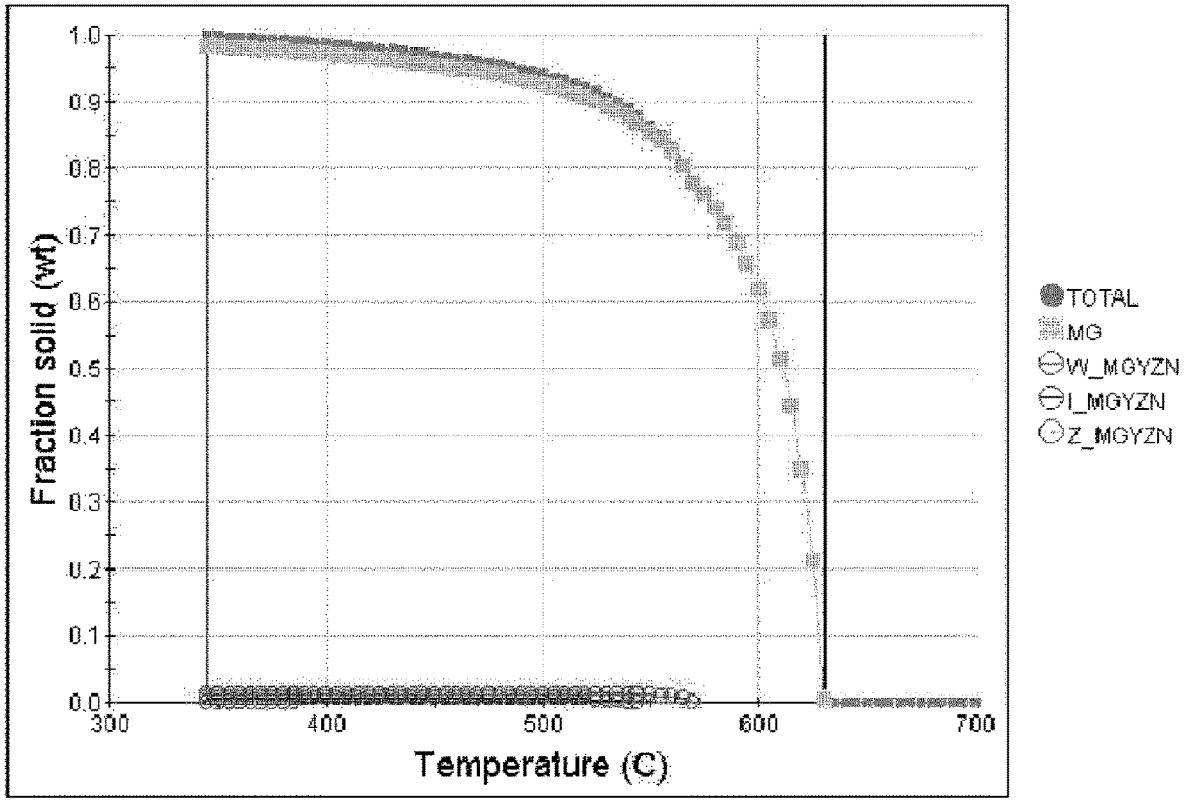
FIG. 4 shows the high-temperature stable phase precipitation diagram of Alloy 2 of Comparative Example.
Figure 5:
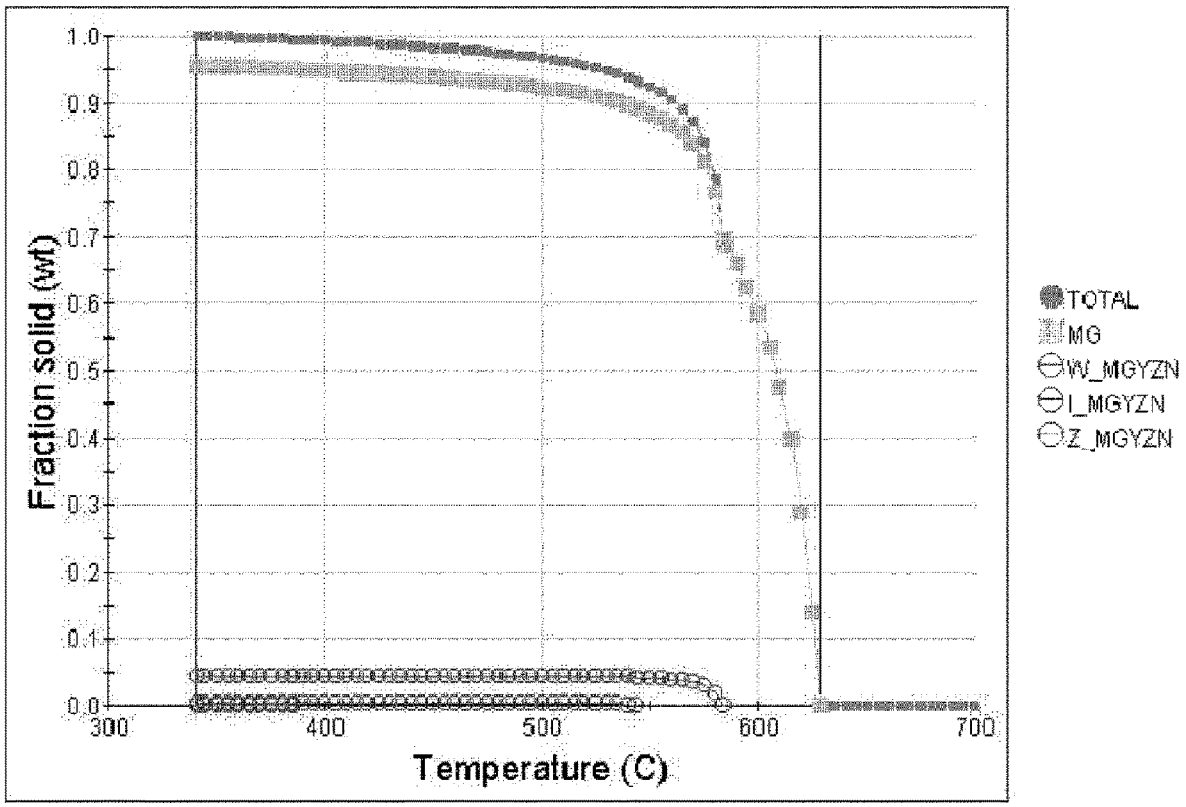
FIG. 5 shows the high-temperature stable phase precipitation diagram of Alloy 3 of Comparative Example.
Figure 6:
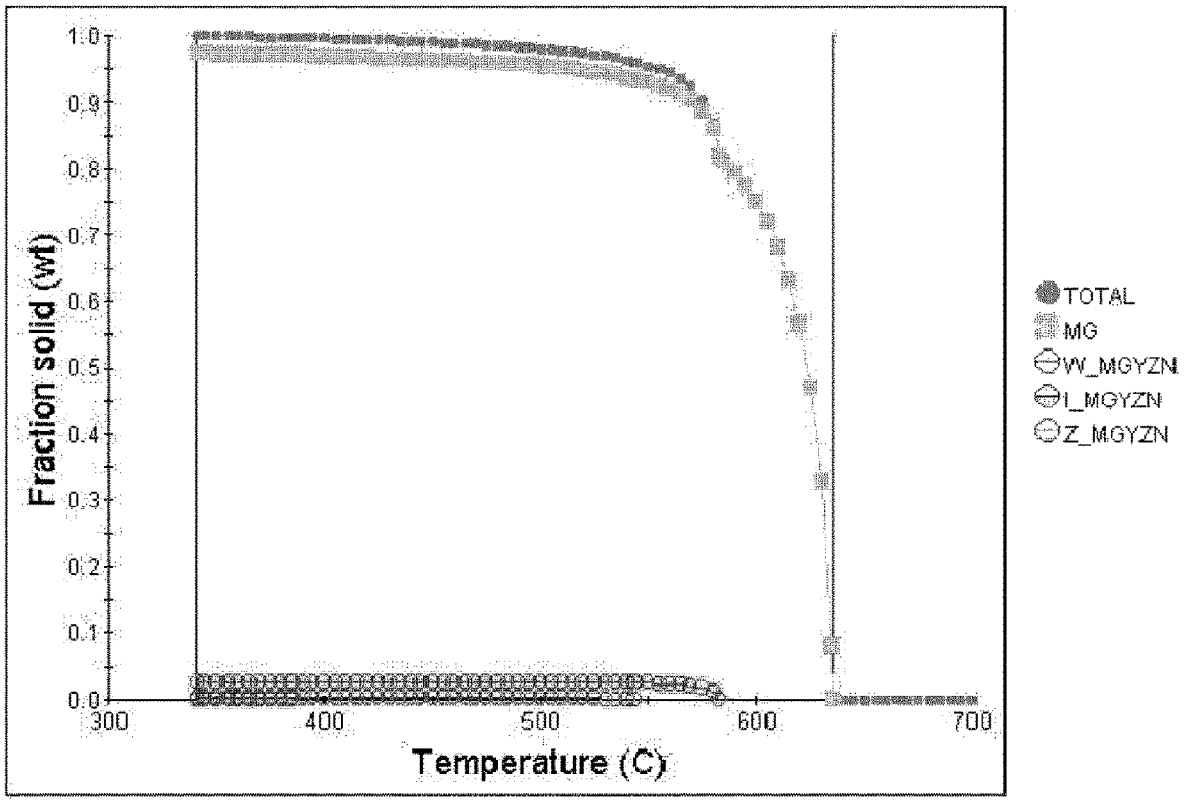
FIG. 6 shows the high-temperature stable phase precipitation diagram of Alloy 4.
Figure 7:
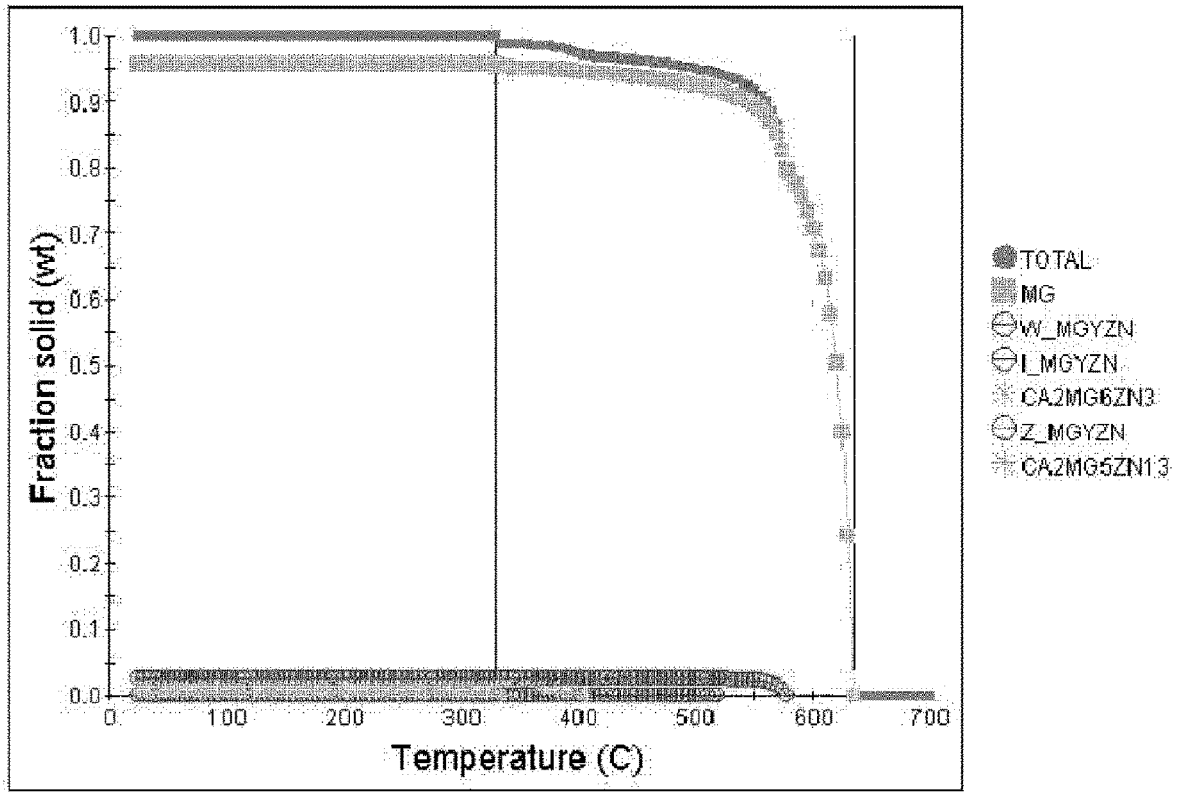
FIG. 7 shows the high-temperature stable phase precipitation diagram of Alloy 5.
Figure 8:
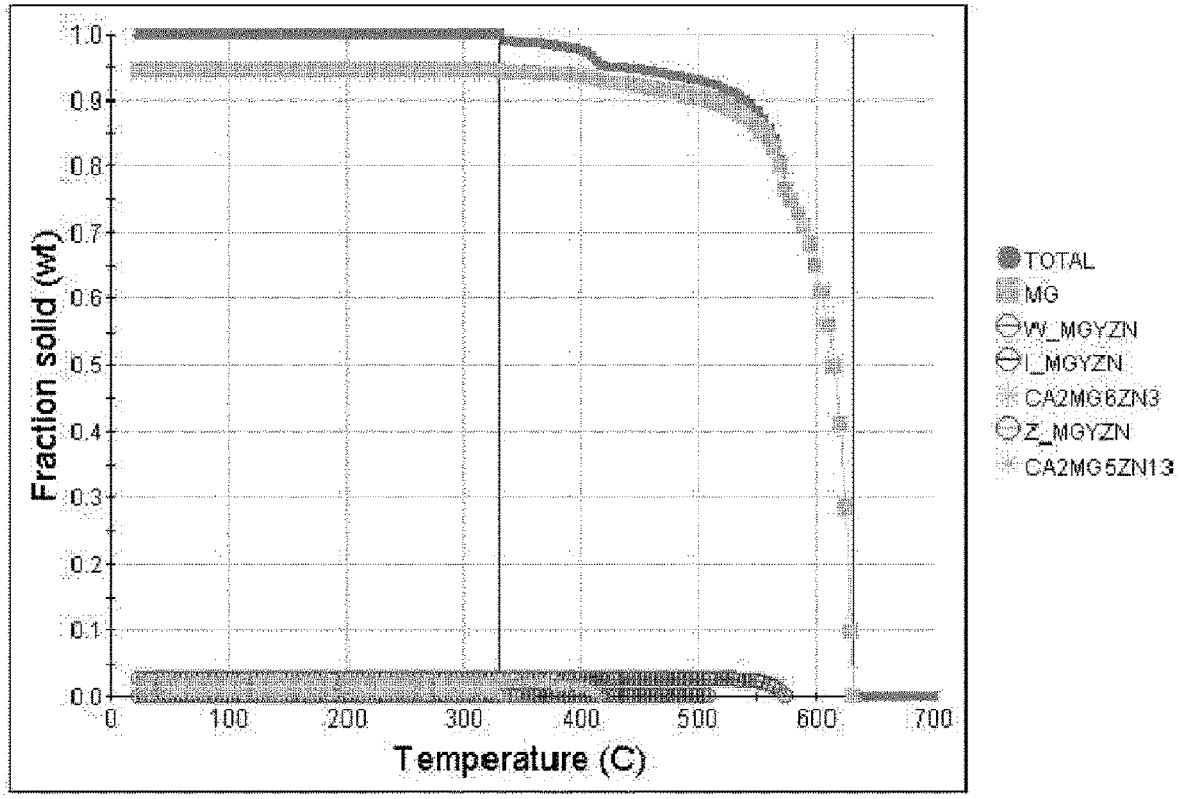
FIG. 8 shows the high-temperature stable phase precipitation diagram of Alloy 6.
Figure 9:
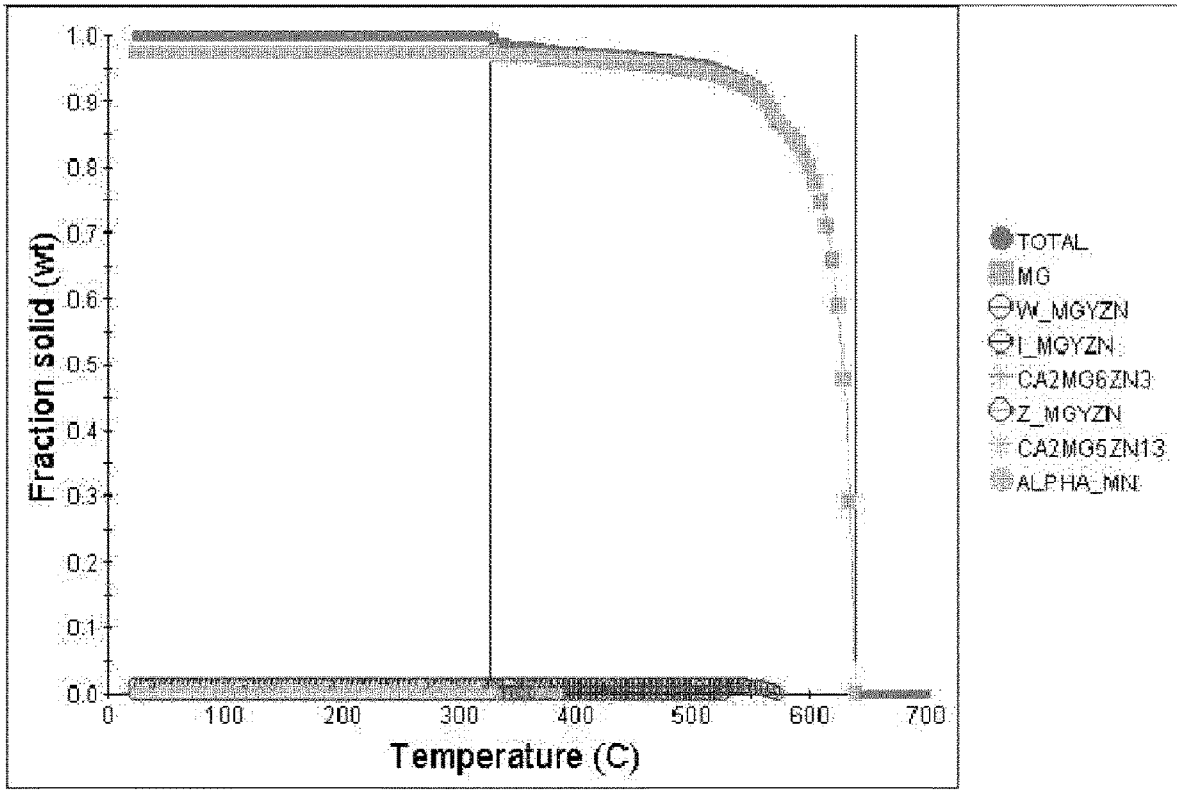
FIG. 9 shows the high-temperature stable phase precipitation diagram of Alloy 7.
Figure 10:
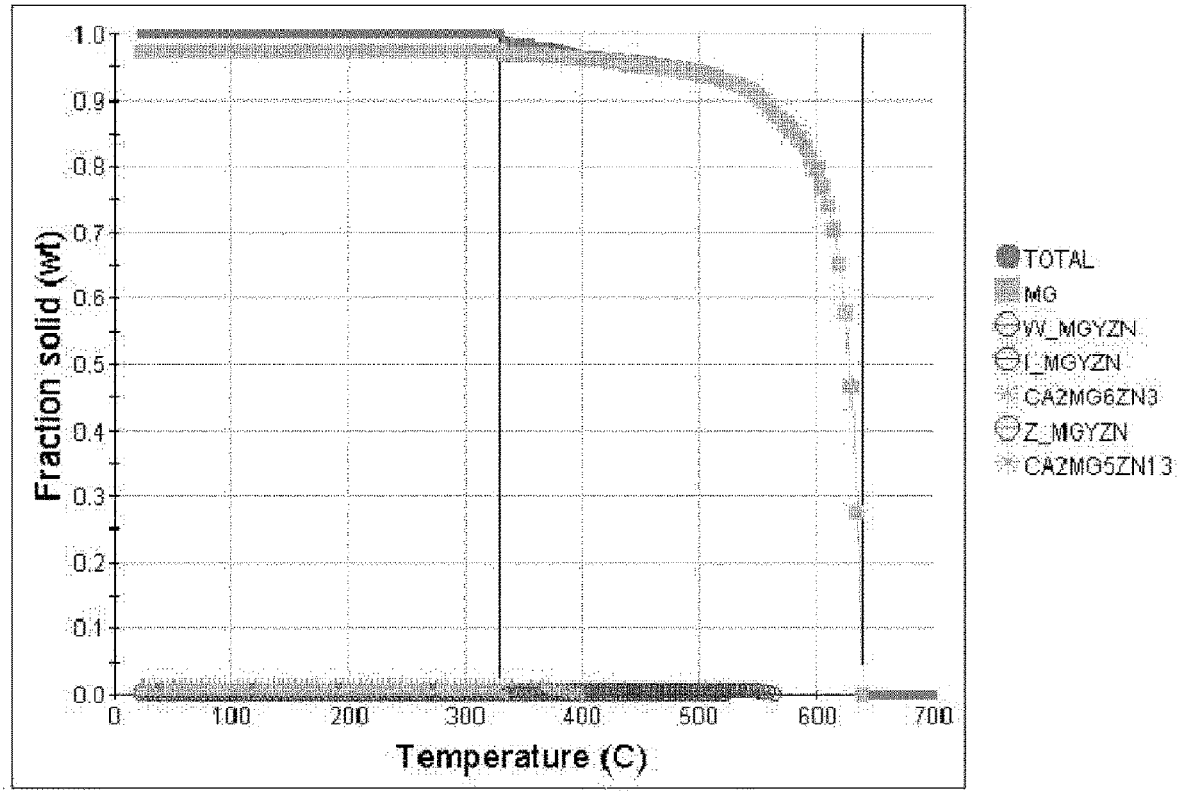
FIG. 10 shows the high-temperature stable phase precipitation diagram of Alloy 8.
Figure 11:
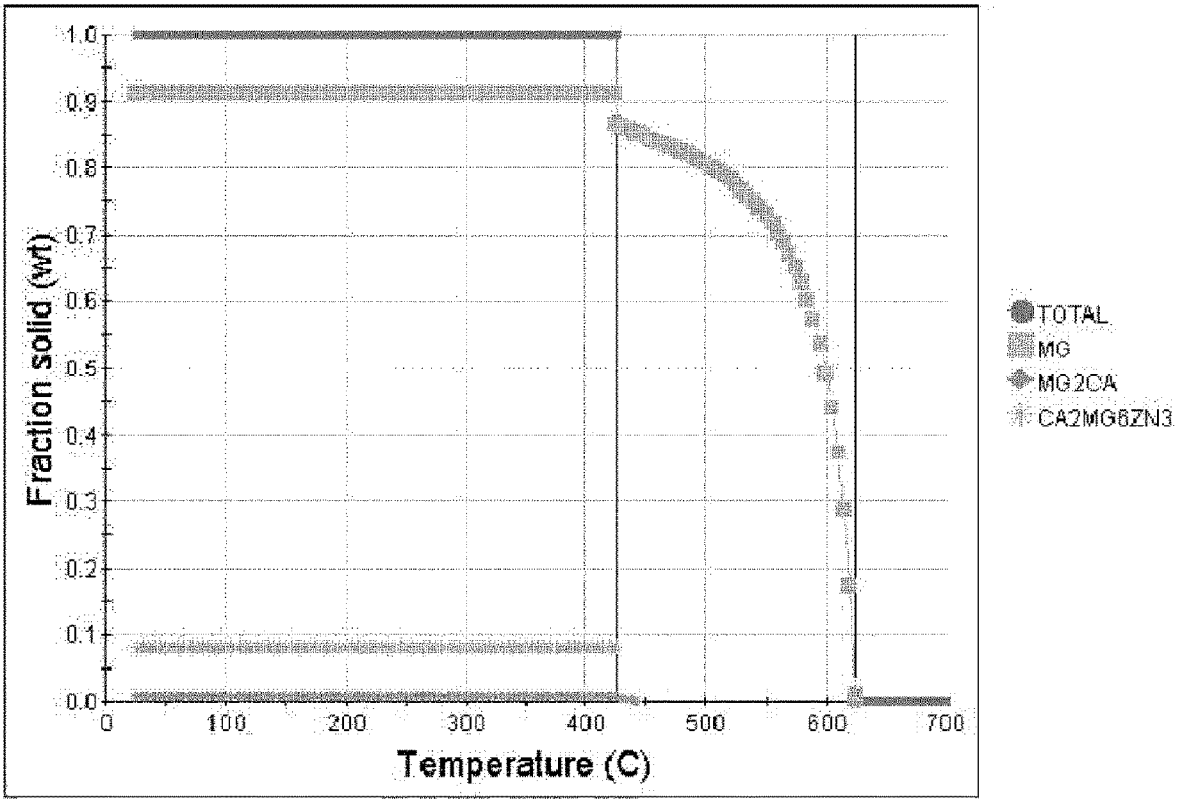
FIG. 11 shows the high-temperature stable phase precipitation diagram of Alloy 9 of Comparative Example.
Figure 12:
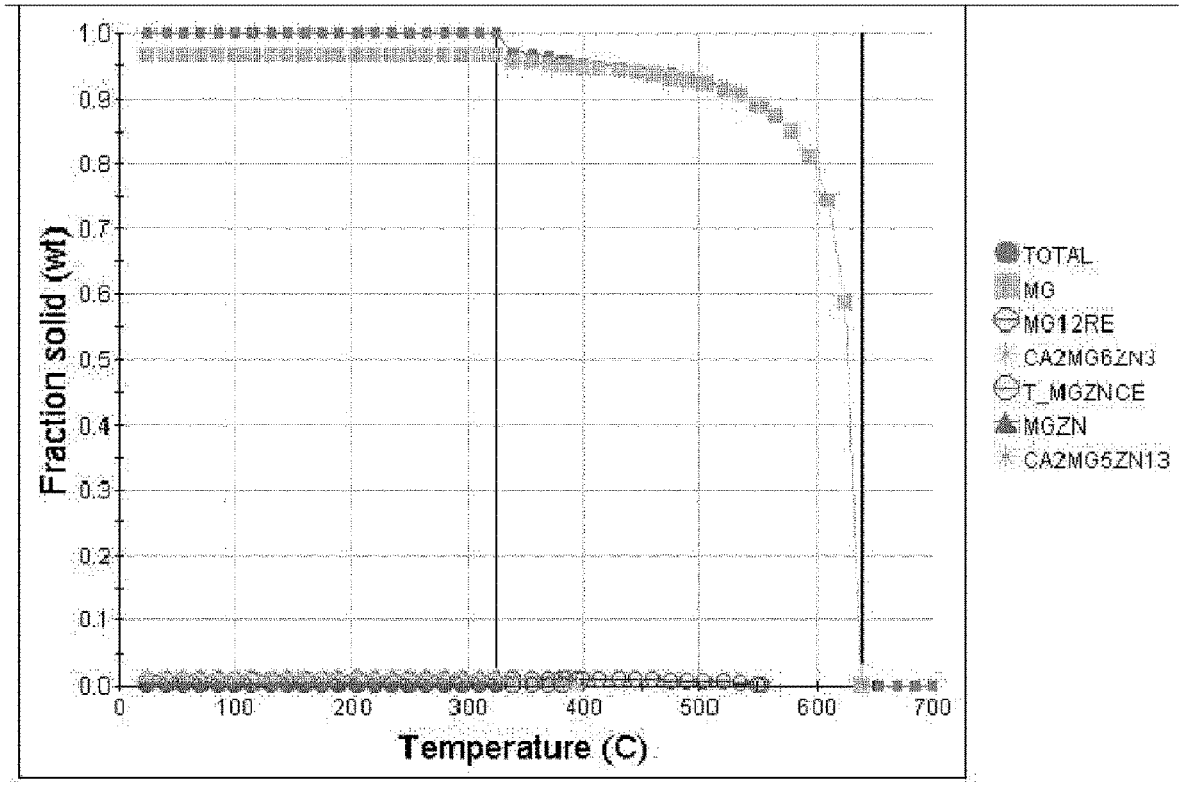
FIG. 12 shows the high-temperature stable phase diagram of Alloy 10.
Figure 13:
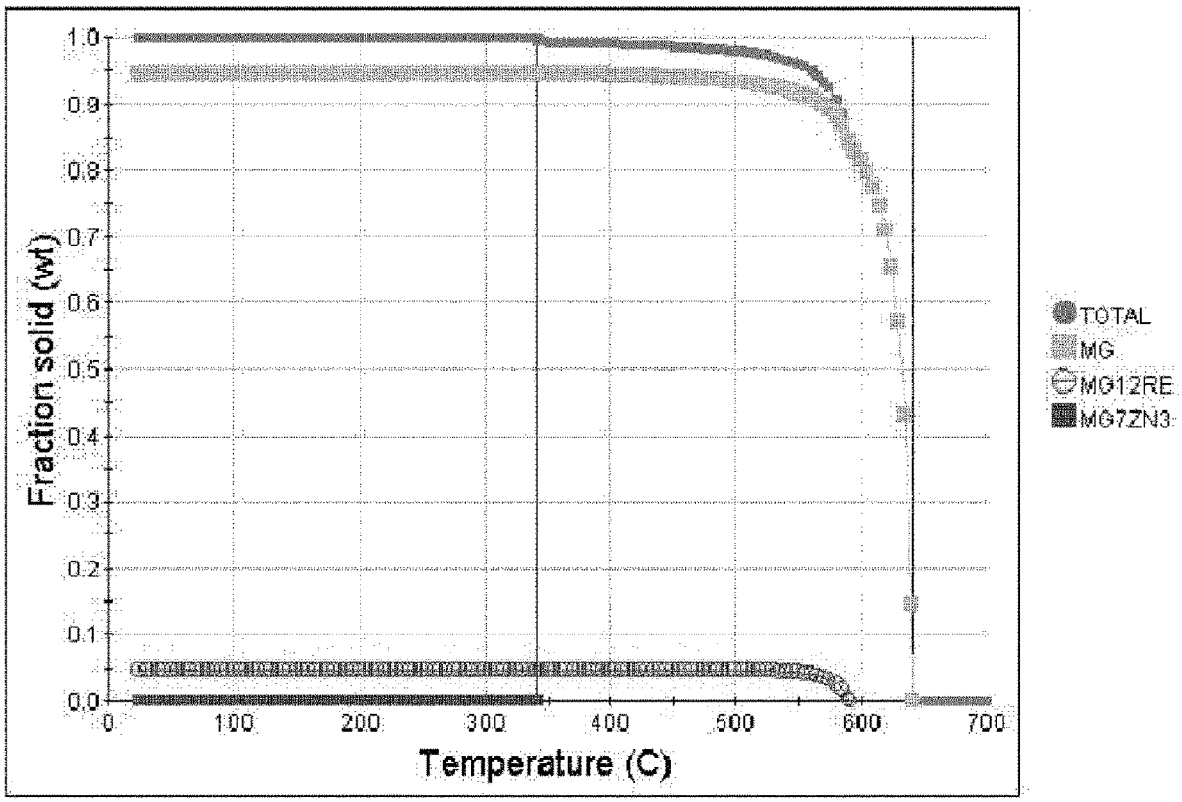
FIG. 13 shows the high-temperature stable phase precipitation diagram of Alloy 11.
Figure 14:
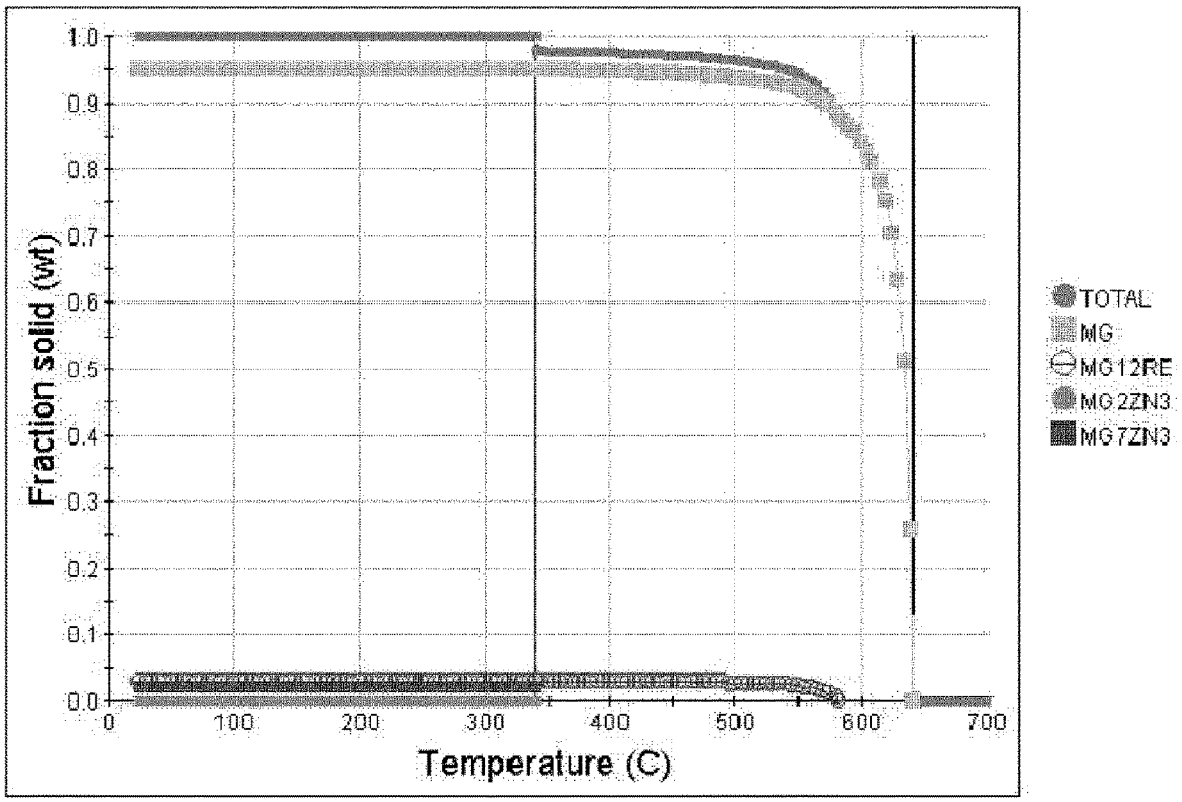
FIG. 14 shows the high-temperature stable phase precipitation diagram of Alloy 12.
Figure 15:
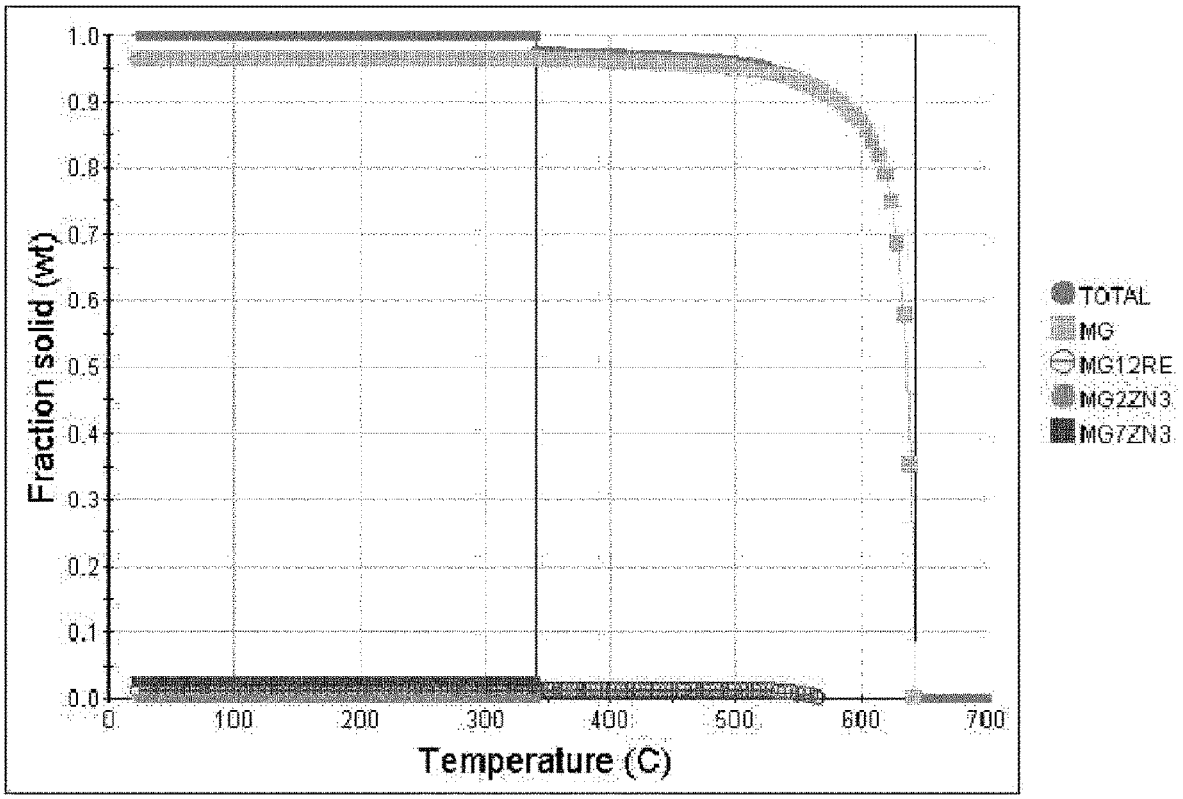
FIG. 15 shows the high-temperature stable phase precipitation diagram of Alloy 13.
Figure 16:
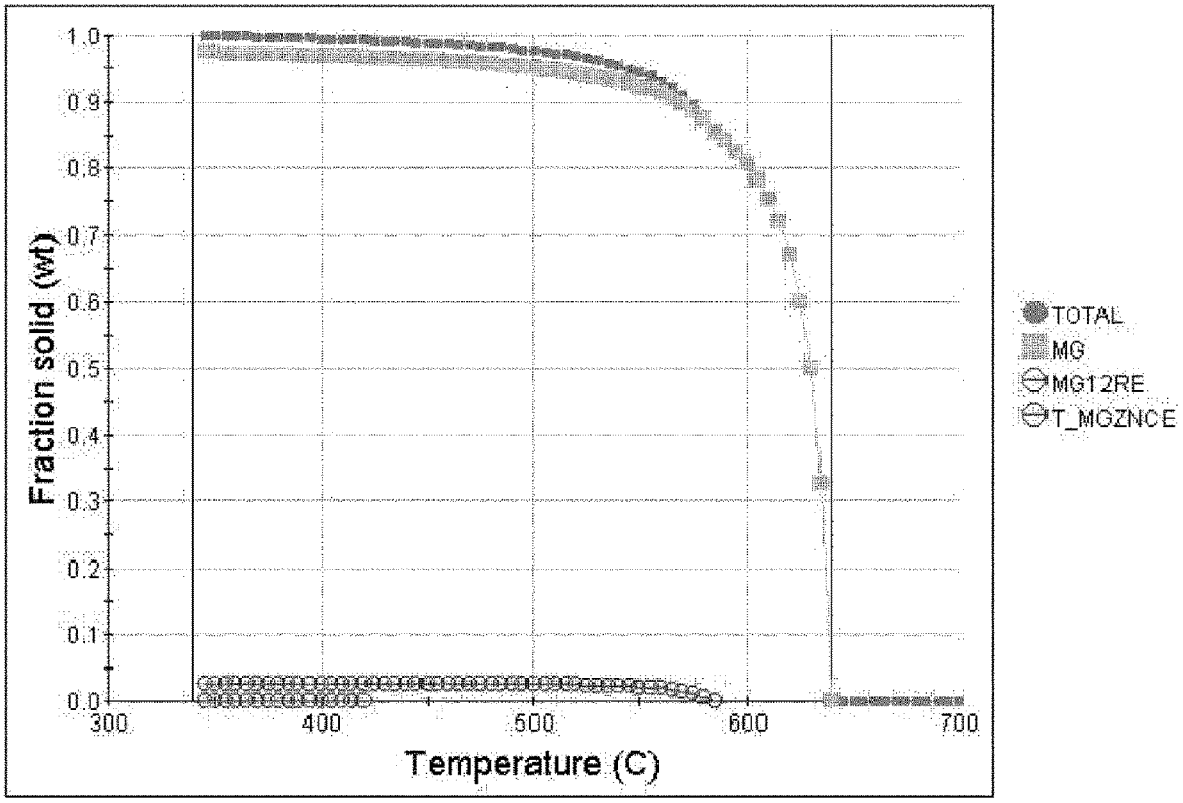
FIG. 16 shows the high-temperature stable phase precipitation diagram of Alloy 14.
Figure 17:
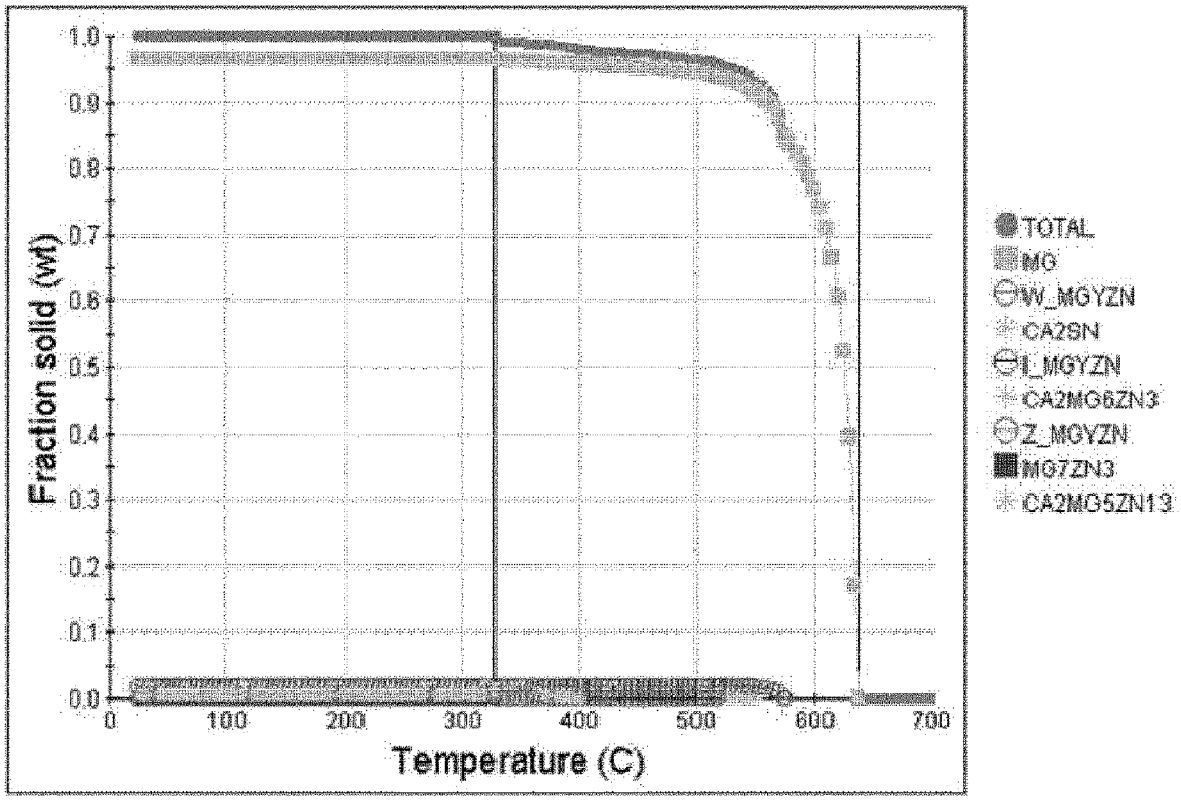
FIG. 17 shows the high-temperature stable phase precipitation diagram of Alloy 15.
Figure 18:
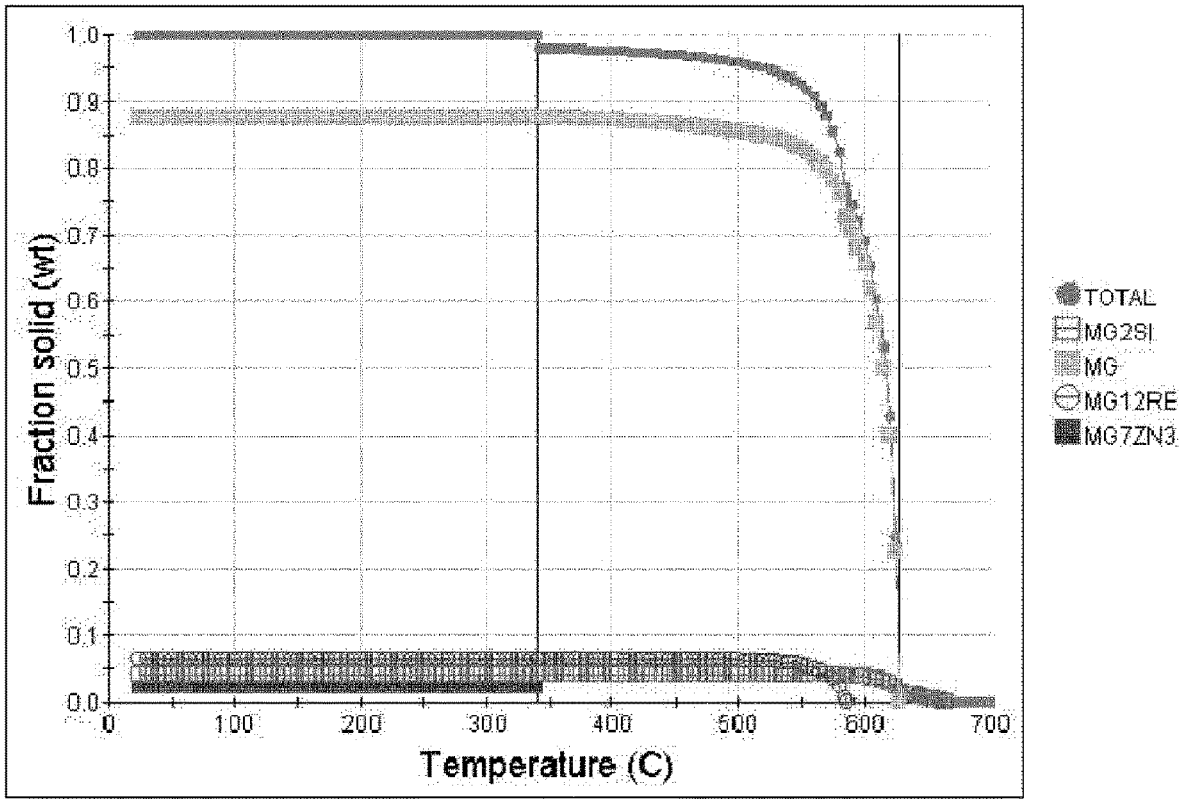
FIG. 18 shows the high-temperature stable phase precipitation diagram of Alloy 16 of Comparative Example.
Figure 19:
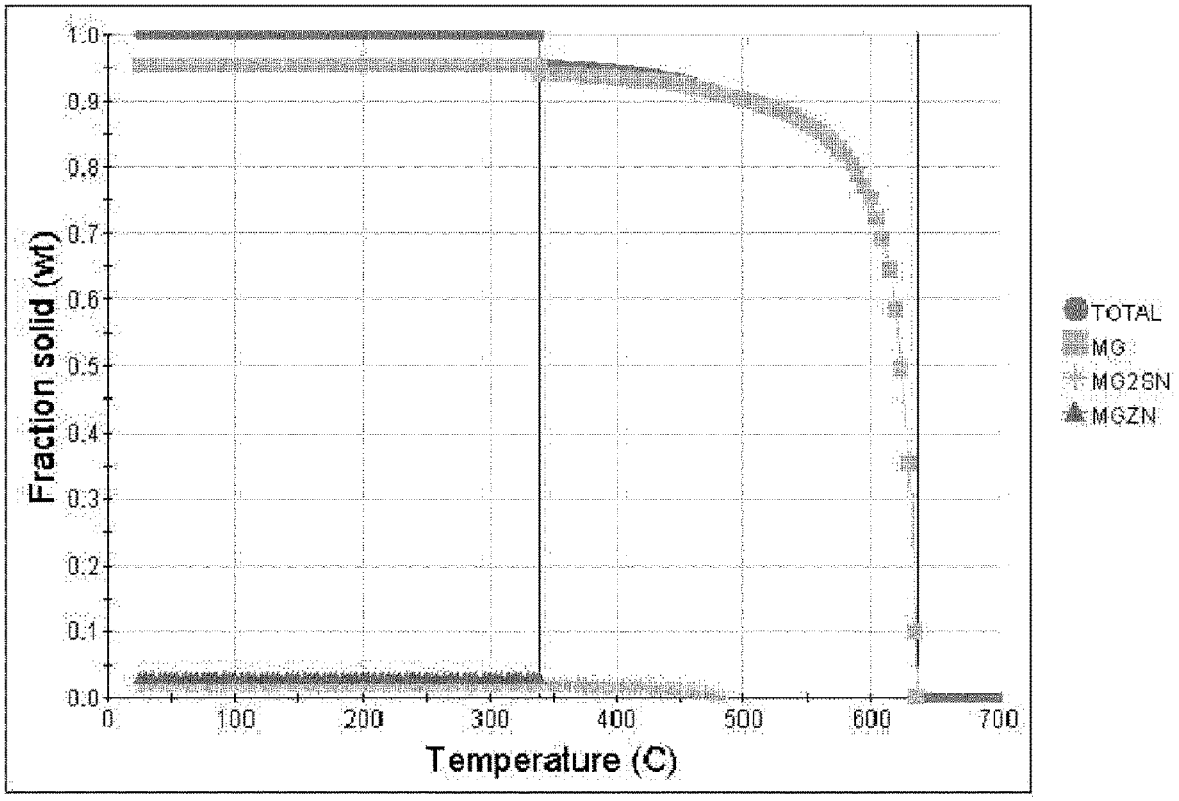
FIG. 19 shows the high-temperature stable phase precipitation diagram of Alloy 17 of Comparative Example.
Figure 20:
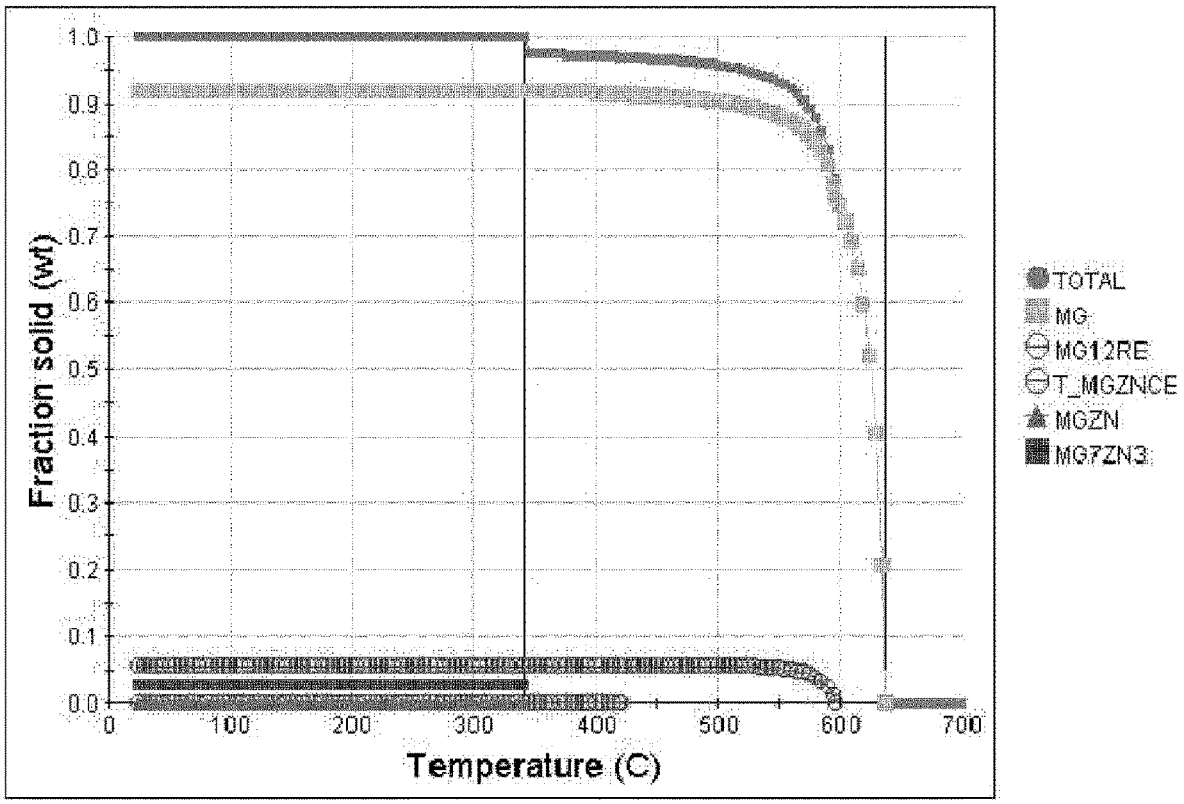
FIG. 20 shows the high-temperature stable phase precipitation diagram of Alloy 18 of Comparative Example.
Figure 21:
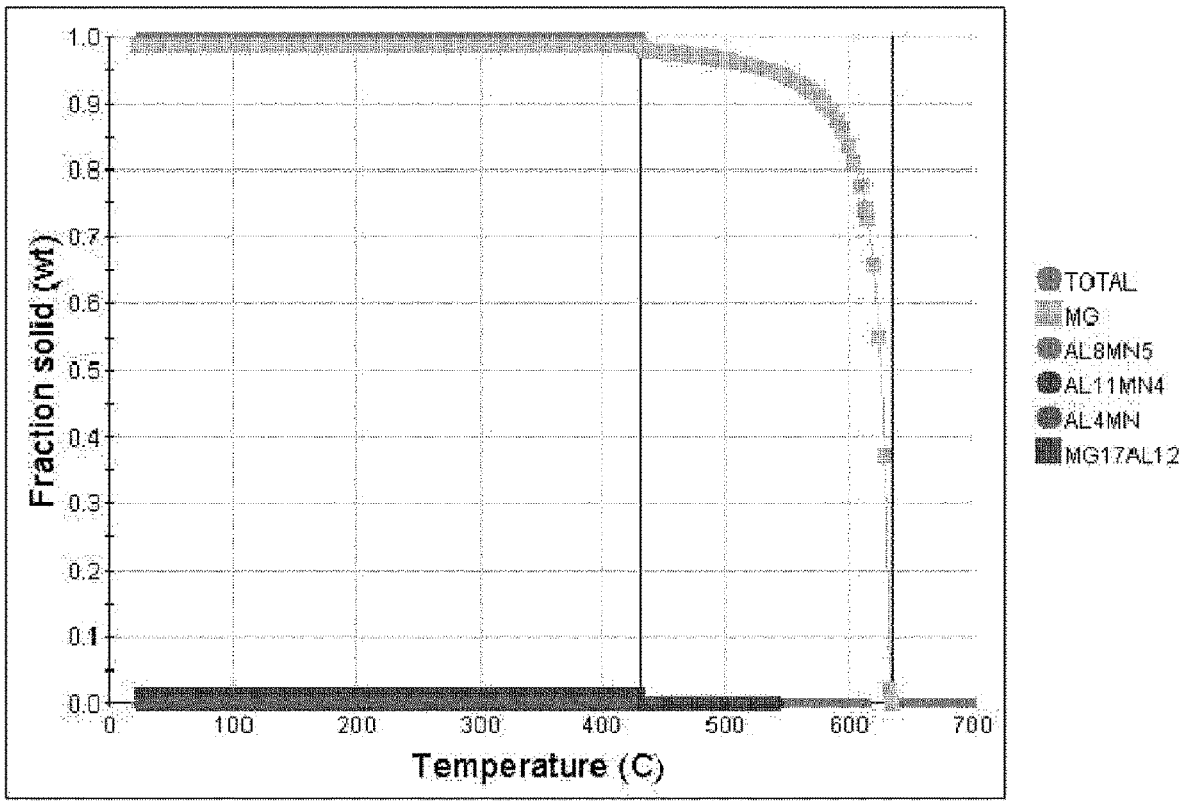
FIG. 21 shows the high-temperature stable phase precipitation diagram of Alloy 19 of Comparative Example.
Figure 22:
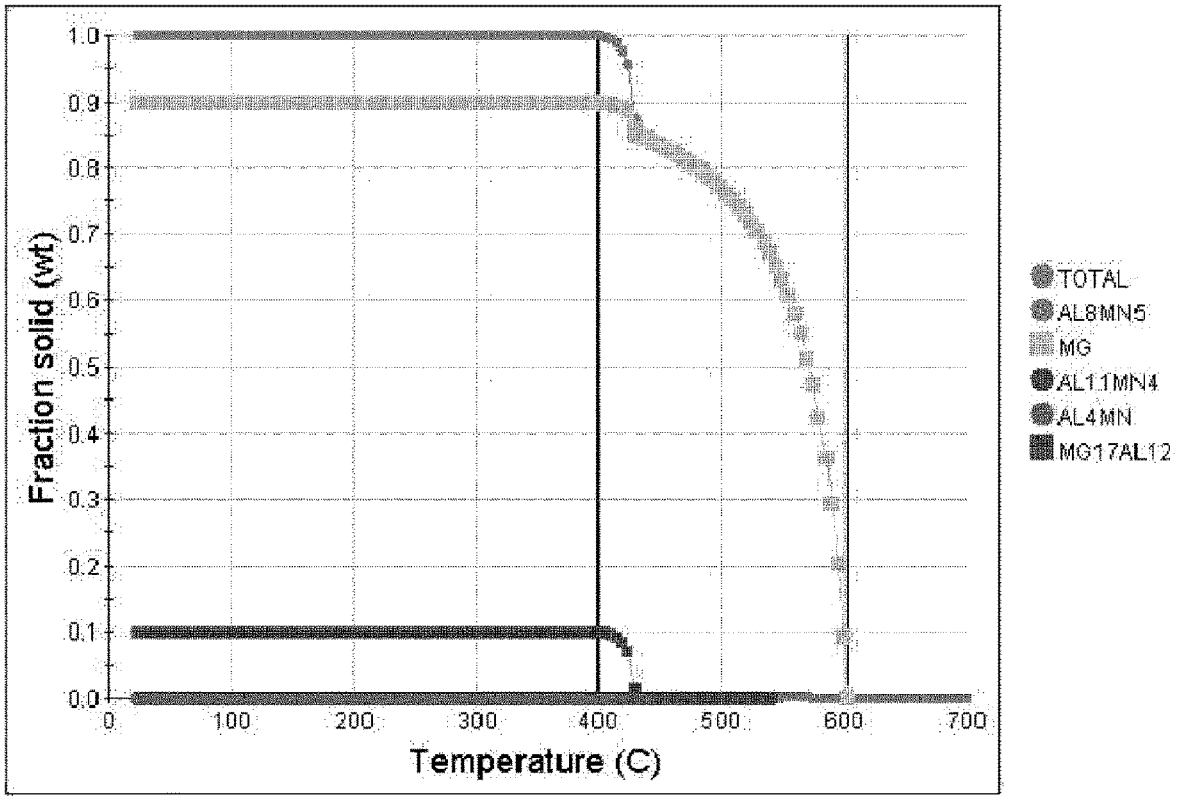
FIG. 22 shows the high-temperature stable phase precipitation diagram of Alloy 20 of Comparative Example.
Figure 23:
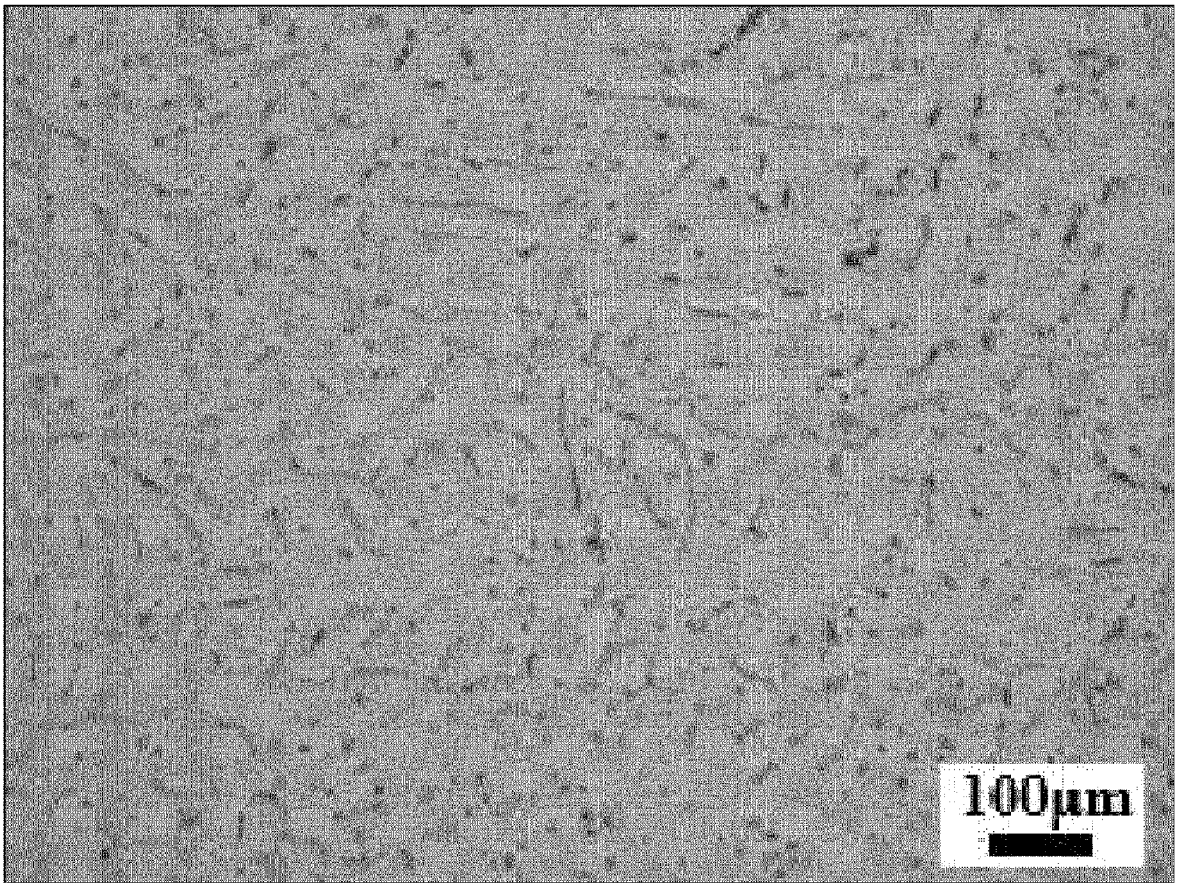
FIG. 23 shows the cast structure of Alloy 5.
Figure 24:
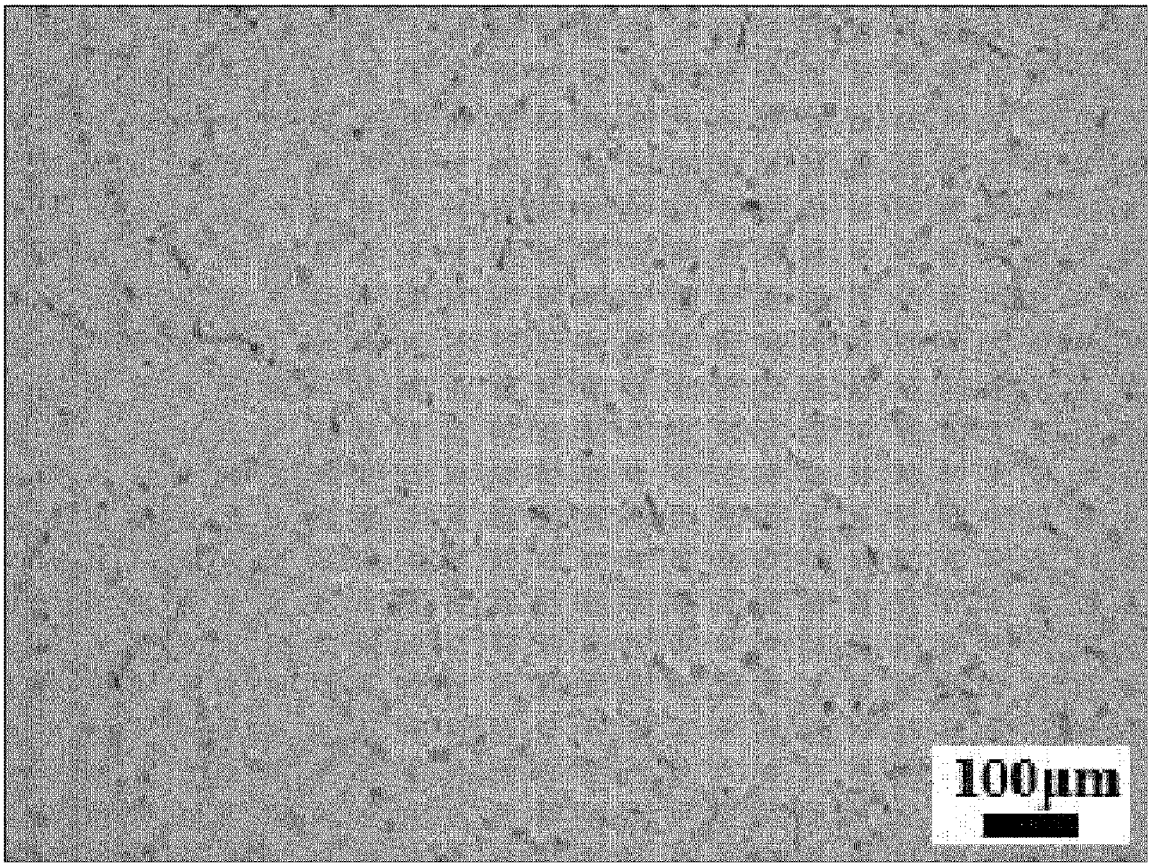
FIG. 24 shows the cast structure of Alloy 7.
Figure 25:
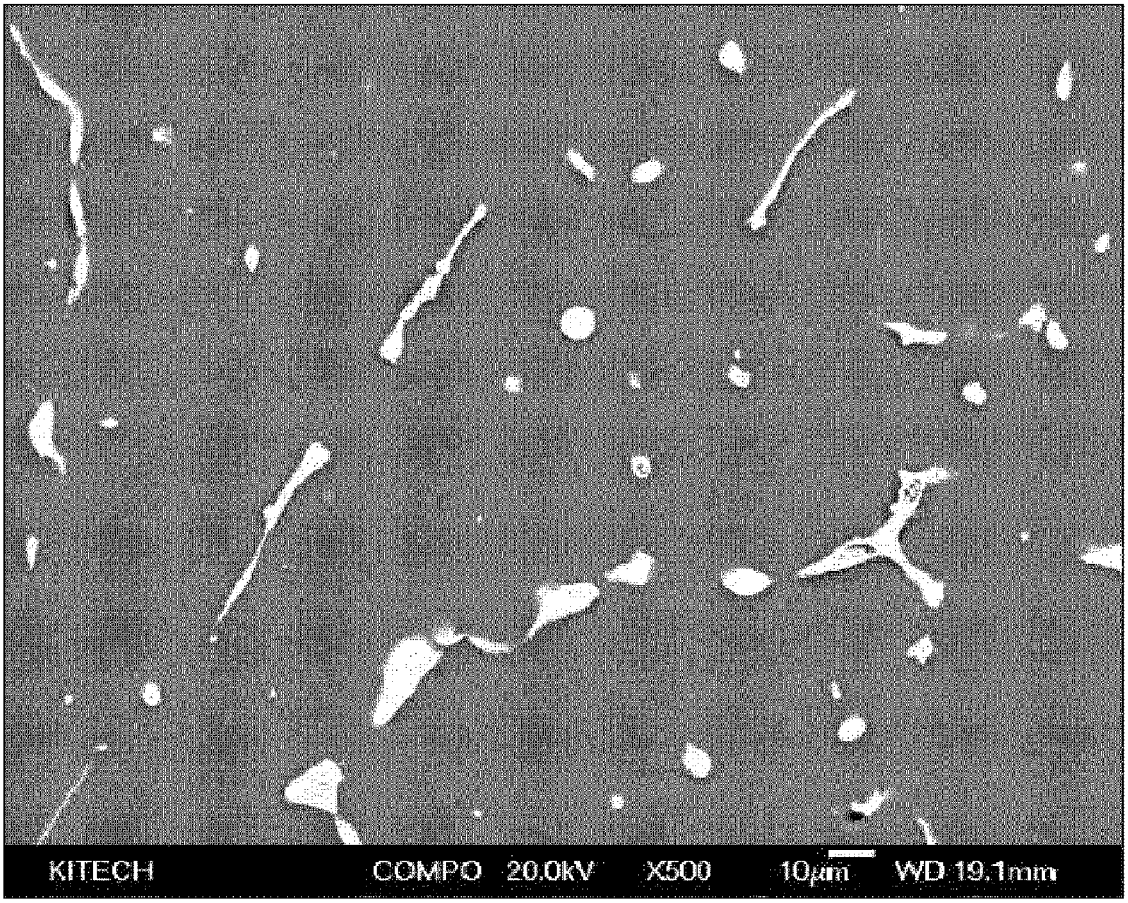
FIG. 25 shows an electron microscope image of the cast structure of Alloy 5.
Figure 26:
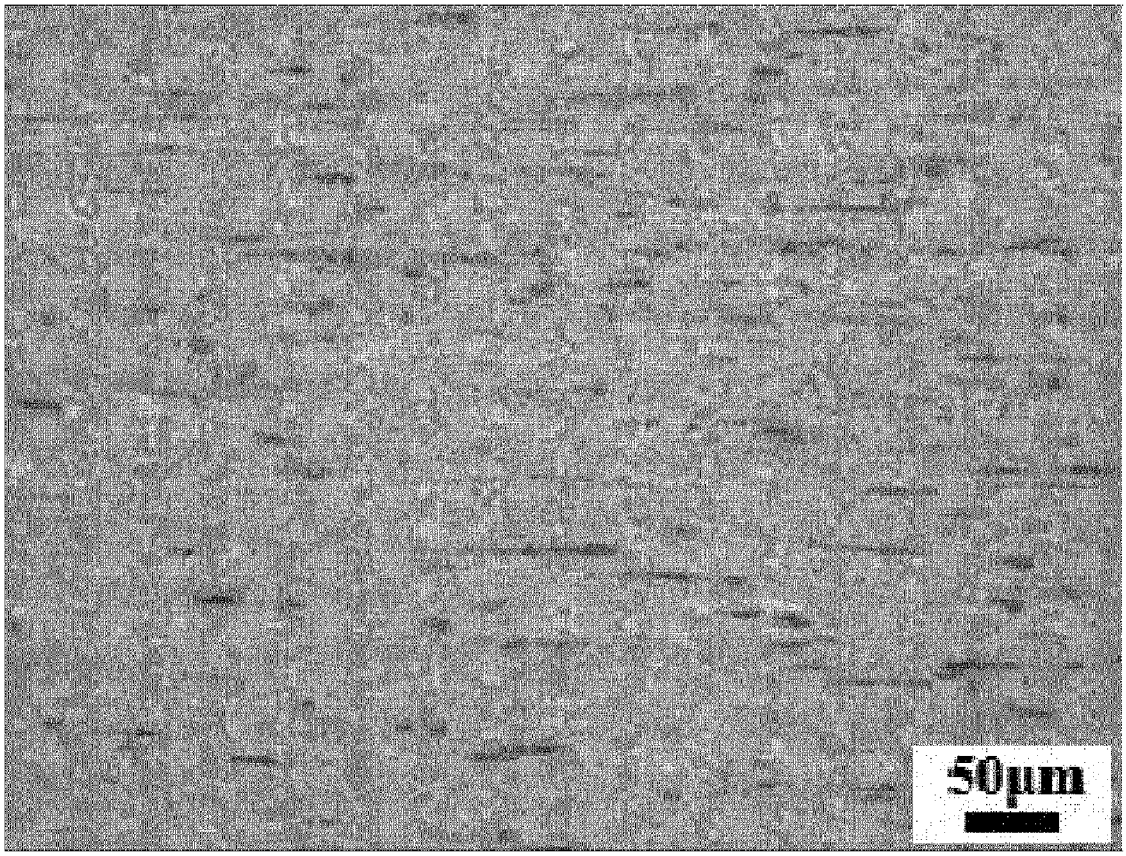
FIG. 26 shows the structure of an extrudate of Alloy 5.
Figure 27:
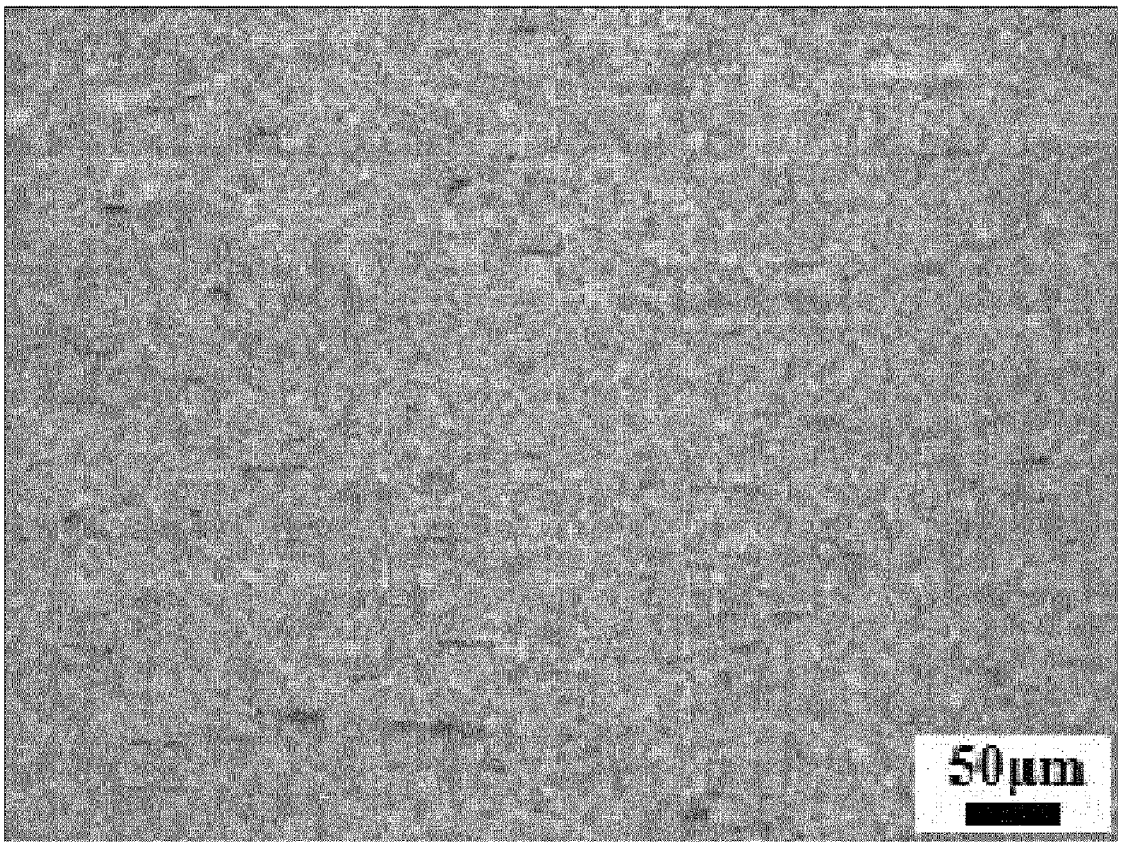
FIG. 27 shows the structure of an extrudate of Alloy 7.

As shown in FIG. 2, in the present invention, the alloy melt is shielded from air by means of shielding gas injected via a shielding gas pipe 4 and a cover 3 provided to a crucible or a continuous mold 1. A stirrer in which a small impeller 22 is provided to a lever 21 made of stainless steel operated by a motor M is placed in the melt via the through-hole in the cover during the solidification of the billet, followed by stirring, whereby the alloy composition becomes uniform. Furthermore, the mushy zone 8 is moved vertically, whereby solidification nuclei are dispersed and crystals are thus fined. The impeller 22 useful in the present invention may be made of another metal, ceramic material, or composite material, or deposition, plating, infiltration or spray coating of the impeller with another material may also fall within the scope of the present invention. The diameter of the impeller is ⅕ to ⅔ of the billet diameter. If the diameter of the impeller exceeds ⅔ of the billet diameter, a large motor is required in order to handle the load. On the other hand, if the diameter of the impeller is less than ⅕ of the billet diameter, stirring effects become insignificant and are thus inadequate to prevent segregation.

The left side of FIG. 2 shows gravitational casting in which a crucible is extracted after melting therein and is then solidified, and the right side thereof shows continuous casting.

Below is a description of the melting in a crucible furnace according to the present invention.

In the present invention, a magnesium alloy melt is manufactured as follows. Specifically, a magnesium ingot is first melted in a crucible furnace and the temperature thereof is maintained at 680 to 720° C. Here, the crucible is made of stainless steel, and the melting atmosphere is formed by blocking contact with air while allowing a gas mixture of carbon dioxide gas and 0.25 to 0.3% of $SF_6$ to flow. Thereafter, among alloy elements, zinc and/or tin are added, and other high-melting-point alloy elements (yttrium, mischmetal, lanthanum, calcium, silicon, manganese) are added in the form of a master alloy close to a eutectic composition. The melt of the alloy elements that are added as shown in Table 1 below is mechanically stirred and stabilized, after which the crucible is extracted and then sank in a cooling bath. In this procedure, the crucible containing the melt is cooled in a manner in which a coolant is sprayed, or in which it is sank in a bath containing a coolant such as water at 30° C. or less, thus promoting the solidification of the melt.

Upon cooling in the bath, the crucible is cooled at a rate of about 70 to 200° C./min depending on the capacity of the bath and the temperature of the coolant. When cooling is performed while the coolant is sprayed, the cooling rate is further increased. On the other hand, when the crucible is spray-cooled in the bath, cooling is performed at a rate of about 200 to 600° C./min. Upon continuous casting, which requires a high solidification rate, the spraying pressure is increased so that the mold and the billet are more strongly cooled, whereby cooling may be performed at a rate of about 400 to 900° C./min. If the cooling rate exceeds 900° C./min, the center thereof may crack due to thermal shrinkage stress based on the difference in cooling rate between the inside and outside of the billet.

During the solidification of the magnesium alloy melt, the impeller made of stainless steel is placed in a crucible and the melt is mechanically stirred two or three times up and down so that the solidification nuclei formed in the cast material are dispersed, thereby obtaining a cast material having low segregation and a fine structure. Through mechanical processing of the cast material, a surface chill is removed to give a billet having a diameter of 74 to 75 mm, followed by diffusion annealing at 380° C. for 2 hr and cooling to room temperature.

Thereafter, the billet subjected to diffusion annealing is preheated at 380° C. for 1.5 hr, and the alloys of Table 1 are extruded using an extrusion die, thus forming a plate having a width of 50 mm and a thickness of 8 mm.

The alloys of Examples of Table 1 were mostly extruded at a pressure of 750 to 900 kgf/cm$^2$. However, Alloys 1 and 2 of Comparative Examples were extruded, but microcracking was present on the surface of the plate due to the low-melting-point eutectic phase, and Alloy 19 of Comparative Example was processed under conditions of an extrusion temperature decreased to about 340° C. and an extrusion pressure increased to 1500 kgf/cm$^2$, whereby surface microcracking was prevented but an excessive self-extinguishing time after removal of the burner in the flammability test and an excessive weight reduction resulted, which are undesirable. In Table 1, the extrusion plastic working was evaluated as follows: the case where a clean and smooth surface was obtained and the extrusion rate satisfied 1.5 to 2 m/min is represented as ○, and the case where fine wrinkles were formed somewhat on the surface or the extrusion rate was about 1 m/min is represented as Δ. The respective causes are described in connection with the unsatisfactory cases.

Alloys 3, 9, 16, 17, 18 and 21 of Comparative Examples were unable to undergo plastic working because the cylinder was stopped or the billet was broken during the processing with an increase in the extrusion pressure in the extrusion process.

Alloy 20 of Comparative Example was extruded under conditions of an extrusion temperature decreased to about 300° C. and a high pressure of 5300 kgf/cm$^2$. Here, lateral cracking occurred due to excessive beta-$Mg_{17}Al_{12}$ precipitation but was removed through processing, thus obtaining a flame-retardant test specimen. However, this test specimen had a low ignition point and did not meet standards for all of initial ignition time, self-extinguishing time and weight reduction in the flammability test.

The plate-like samples thus obtained were subjected to diffusion annealing at 380° C. for 1 hr and processed to a diameter of 12.7 mm and a thickness of 2 mm. Based on the results of measurement of thermal conductivity using a laser flash process in accordance with ASTM E4161, the alloys of the present invention (Alloys 4, 5, 6, 7, 8, 10, 11, 12, 13, 14, and 15) exhibited thermal conductivity of 125 W/m·K or more at a high temperature of 100° C. or more.

The chips obtained from the above samples were measured for ignition points through thermogravitational analysis (TGA) using a differential scanning calorimeter (DSC), and were processed into test specimens having a width of 38.1 mm, a thickness of 6.4 mm, and a length of 508 mm, each of which was then subjected to two flammability tests through burner heating.

As set forth in Table 1, the alloys of the present invention satisfied plastic workability and thermal conductivity, as well as flame retardancy conditions including an ignition point of 550° C. or more, an ignition time of 120 sec or more, a self-extinguishing time of the test specimen within 180 sec after extinguishment of the burner, and a weight reduction of 10% or less.

As is apparent from the above results, the total amount of the alloy elements in the alloys of Comparative Examples was 6.25 to 9.45%, and thus ductility deteriorated and extrusion stress was greatly increased or thermal conductivity was decreased.

In contrast, the alloys of Examples of the present invention were manufactured in the range of 2.4 to 5.6%, whereby superior thermal conductivity and flame retardancy and easy plastic working resulted.

TABLE 1

| Alloy No. | Zn (wt %) | High-melting-point oxide-film-forming element (wt %) | Ignition point (TGA, ° C.) | Flammability test (FAA/TC-13/52) Ignition time (sec) | Self-extinguishing time (sec) | Weight reduction (%) | Extrusion plastic working | Thermal conductivity W/m · K |
|---|---|---|---|---|---|---|---|---|
| 1 C. Ex. | 6.2 | Y 0.05 | 431, 456 | 82, 109 | 187, 235 | 34.6, 37.3 | Δ | 94 |
| 2 C. Ex. | 6.2 | Y 0.5 | 487, 503 | 106, 118 | 173, 204 | 9.5, 10.2 | Δ | 91 |
| 3 C. Ex. | 6.2 | Y 1.5 | — | — | — | — | Broken | — |
| 4 | 4 | Y 1.0 | 757, 894 | 173, 198 | 63, 86 | 0.5, 0.6 | ○ | 131 |
| 5 | 4 | Y 1.0, Ca 0.3 | 1009, 1030 | 167, 216 | 39, 79 | 0.4, 0.6 | ○ | 137 |
| 6 | 4.5 | Y 1.0, Ca 0.1 | 797, 822 | 175, 206 | 28, 76 | 0.4, 0.5 | ○ | 139 |
| 7 | 3.0 | Y 0.5, Ca 0.2, Mn 0.2 | 838, 925 | 158, 184 | 15, 114 | 0.2, 1.1 | ○ | 132 |
| 8 | 3.0 | Y 0.3, Ca 0.3 | 845, 878 | 162, 174 | 39, 46 | 0.6, 1.5 | ○ | 142 |
| 9 C. Ex. | 4.5 | Ca 2.0 | — | — | — | — | Stopped | — |
| 10 | 3.0 | Ca 0.3, mischmetal 0.3 | 813, 851 | 175, 193 | 35, 48 | 0.7, 1.3 | ○ | 148 |
| 11 | 2.0 | La 1.5 | 995, 1028 | 209, 224 | 10, 15 | 0.1, 0.1 | ○ | 141 |
| 12 | 2.0 | La 0.9 | 879, 943 | 162, 227 | 10, 33 | 0.2, 0.4 | ○ | 139 |
| 13 | 2.0 | La 0.4 | 617, 651 | 135, 178 | 77, 98 | 0.6, 0.8 | ○ | 135 |
| 14 | 3.0 | Mischmetal 0.9 | 881, 935 | 153, 195 | 17, 29 | 0.2, 0.2 | ○ | 132 |
| 15 | 3.0 | Y 0.8, Ca 0.3, Sn 0.5 | 957, 968 | 188, 221 | 21, 48 | 0.2, 0.3 | ○ | 128 |
| 16 C. Ex. | 3.0 | La 2.0, Si 1.5 | — | — | — | — | Stopped | — |
| 17 C. Ex. | 3.0 | Sn 4.0 | — | — | — | — | Stopped | — |
| 18 C. Ex. | 3.0 | Mn 1.5, mischmetal 2.0 | — | — | — | — | Stopped | — |
| 19 C. Ex. | 0.91 | Al 2.8, Mn 0.2 | 553, 588 | 101, 109 | 300, 360 | 73.8, 80.9 | ○ | 87 |
| 20 C. Ex. | 0.75 | Al 8.5, Mn 0.2 | 376, 425 | 78, 96 | 330, 360 | 32.3, 45.4 | Δ | 52 |
| 21 C. Ex. | — | Al 6.2, Y 2.0, Mn 0.4 | — | — | — | — | Stopped | — |

FIGS. 3 to 22 show the high-temperature stable phase precipitation diagrams of the alloys of Examples of the present invention and Comparative Examples, in which the high-temperature stable phase begins to appear at a temperature of at least 430° C., but the high-temperature stable phase is insufficiently or excessively precipitated in Comparative Examples. FIGS. 23 to 27 show the structures of the alloys of the present invention. As shown in the precipitates of the cast structures of FIGS. 23 to 25, the formation of a coarse lamellar phase at grain boundaries was suppressed, and as is apparent from the structures of extrudates of FIGS. 26 and 27, the precipitates were finely dispersed during the extrusion.

Figure 28:
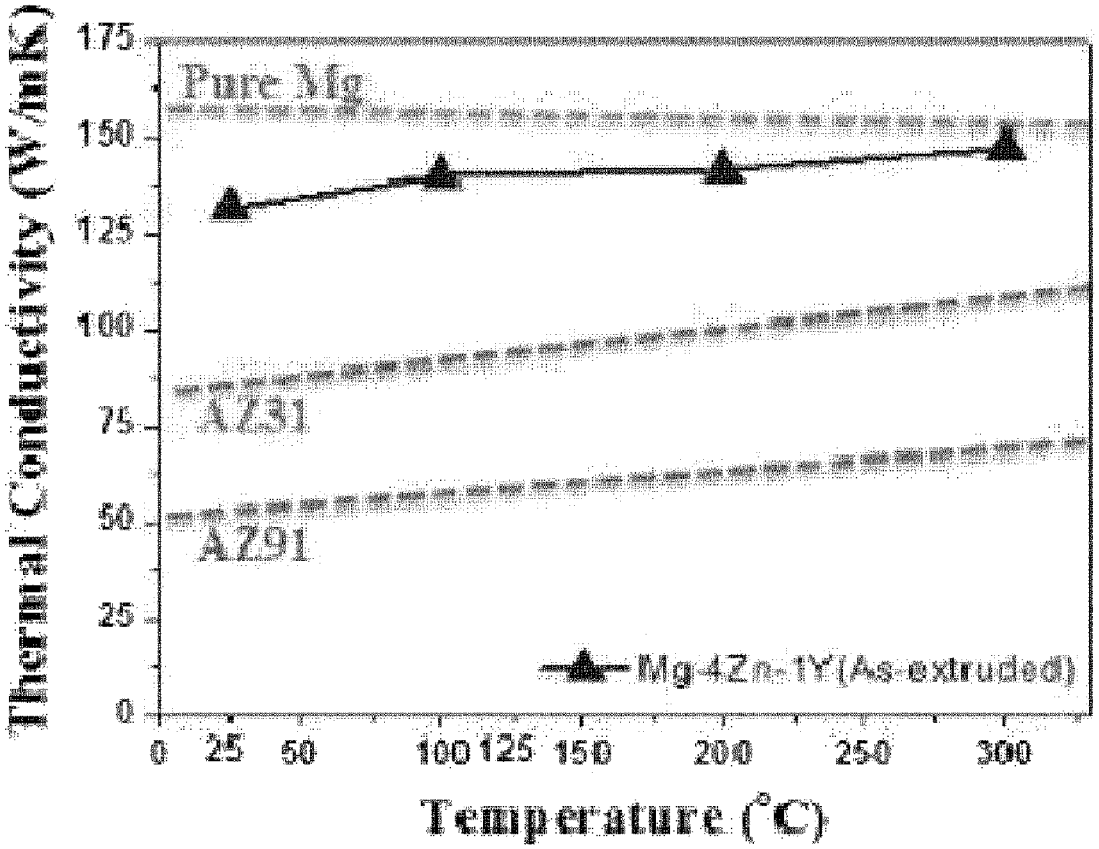
FIG. 28 shows the thermal conductivity of Alloy 4.
Figure 29:
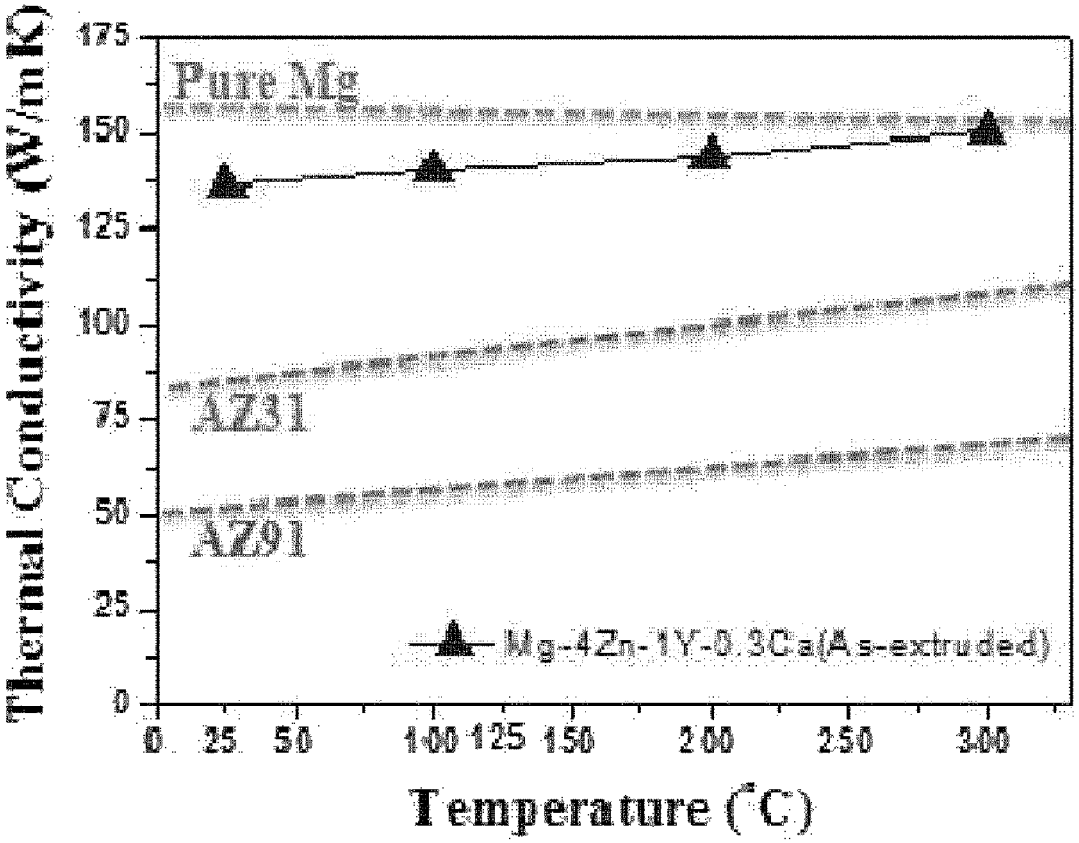
FIG. 29 shows the thermal conductivity of Alloy 5.
Figure 30:
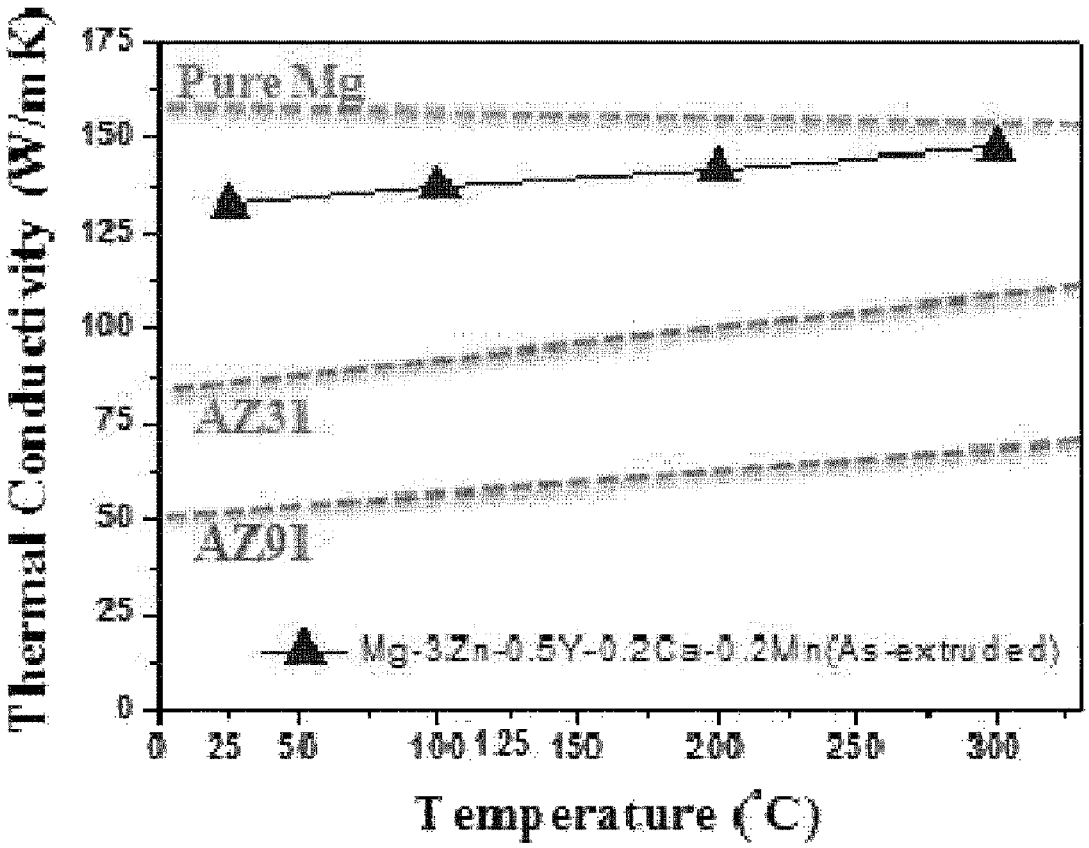
FIG. 30 shows the thermal conductivity of Alloy 7.
Figure 31:
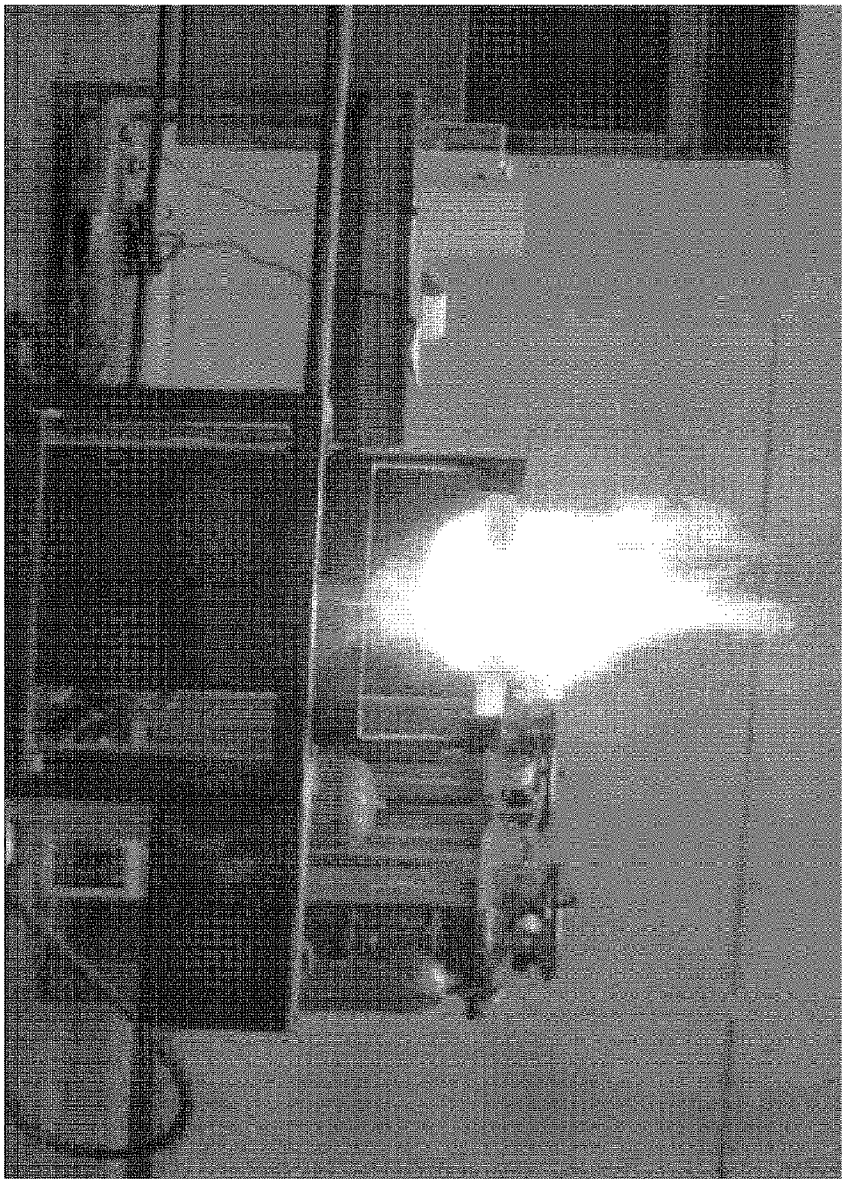
FIG. 31 shows a flammability test environment.

FIGS. 28 to 30 show the graphs of measurement of thermal conductivity according to the present invention. As set forth in Table 1, the alloy of the present invention exhibited thermal conductivity of 125 W/m·K or more, which is higher than 51 to 54 W/m·K of WE43, 24 W/m·K of ZE41, or 116 W/m·K of Elektron 21, as the conventional AZ-based alloy or the currently useful flame-retardant alloy, and effectively satisfied the flammability test. FIG. 31 shows the flammability test environment of the present invention, in which the alloy of the present invention having high thermal conductivity is able to decrease an effect of shortening the melt-down time due to partial heating when exposed to flame, thus increasing flame retardancy.

| [Description of Reference Numerals] | |
|---|---|
| 1: mold | 2: billet cast material |
| 3: cover | 4: shielding gas pipe |
| 5: inlet | 6: continuous casting billet stand |
| 7: coolant spray nozzle | 8: mushy zone |
| 21: lever | 22: impeller |
| 41: induction coil | M: motor |

What is claimed is:

1. A plastic deformation magnesium alloy having thermal conductivity, flame retardancy, and facilitating plastic working, the magnesium alloy consisting of:

0.5 to 5 wt % of zinc;

0.3 to 2.0 wt % of at least one of yttrium, lanthanum and mischmetal as oxide-film-forming elements;

less than 1.0 wt % of at least one selected from among calcium, silicon, and tin, wherein a total amount of alloy elements is 2.5 to 6 wt %; and the balance magnesium.

2. The plastic deformation magnesium alloy of claim 1, wherein the oxide-film-forming element is the lanthanum.

* * * * *